US011077702B2

(12) United States Patent
Cauwels et al.

(10) Patent No.: US 11,077,702 B2
(45) Date of Patent: Aug. 3, 2021

(54) RETRACTABLE NOSECONE WRITING INSTRUMENT

(71) Applicant: Sanford, L.P., Atlanta, GA (US)

(72) Inventors: Kyle Cauwels, Bloomingdale, IL (US); David Moraski, Naperville, IL (US); James Bergman, Sugar Grove, IL (US)

(73) Assignee: SANFORD, L.P., Atlanta, GA (US)

( * ) Notice: Subject to any disclaimer, the term of this patent is extended or adjusted under 35 U.S.C. 154(b) by 0 days.

(21) Appl. No.: 16/647,668

(22) PCT Filed: Sep. 19, 2018

(86) PCT No.: PCT/US2018/051793

§ 371 (c)(1),
(2) Date: Mar. 16, 2020

(87) PCT Pub. No.: WO2019/060439

PCT Pub. Date: Mar. 28, 2019

(65) Prior Publication Data

US 2020/0230997 A1 Jul. 23, 2020

Related U.S. Application Data

(60) Provisional application No. 62/560,411, filed on Sep. 19, 2017.

(51) Int. Cl.
*B43K 24/02* (2006.01)
*B43K 7/00* (2006.01)
(Continued)

(52) U.S. Cl.
CPC ..... *B43K 24/026* (2013.01); *B43K 7/005* (2013.01); *B43K 5/005* (2013.01); *B43K 8/003* (2013.01)

(58) Field of Classification Search
CPC .... B43K 24/026; B43K 24/005; B43K 21/00; B43K 21/18; B43K 24/00; B43K 24/02;
(Continued)

(56) References Cited

U.S. PATENT DOCUMENTS 2,941,511 A * 6/1960 Cieremans ..... B43K 7/005 401/116
4,595,307 A * 6/1986 Heyden ..... B43K 23/10 401/117
(Continued)

FOREIGN PATENT DOCUMENTS

KR 20010000225 A 1/2001
WO 2008/089138 A2 7/2008

OTHER PUBLICATIONS

International Search Report and Written Opinion for International Application No. PCT/US2018/51793 dated Dec. 6, 2018 (8 pages).
(Continued)

*Primary Examiner* — David J Walczak
(74) *Attorney, Agent, or Firm* — Eversheds Sutherland (US) LLP

(57) ABSTRACT

A writing instrument includes a body, a nosecone, and an adaptor each being of generally hollow tubular shape. The body, the nosecone, and the adaptor each have a first end and a second end. The first end of the adaptor is configured to slidably couple to the nosecone second end. The second end of the adaptor is coupled to the first end of the body. The writing instrument includes a writing element with a mounting end and a writing end where the mounting end is removably coupled to the second end of the body. The writing instrument includes a locking mechanism configured to selectively lock the nosecone in a storage position or a writing position. In the storage position, the nosecone extends and covers the writing end. In the writing position, the nosecone retracts and the writing end of the writing element extends beyond the nosecone.

18 Claims, 23 Drawing Sheets

(51) Int. Cl.
*B43K 5/00* (2006.01)
*B43K 8/00* (2006.01)

(58) Field of Classification Search
CPC ..... B43K 24/03; B43K 24/04; B43K 24/06; B43K 24/08; B43K 24/084
USPC ..... 401/107, 108, 117
See application file for complete search history.

(56) References Cited

U.S. PATENT DOCUMENTS

| | | | | |
|---|---|---|---|---|
| 4,780,016 | A * | 10/1988 | Kim | B43K 23/10 401/116 |
| 8,079,767 | B2 * | 12/2011 | Rolion | B43K 23/12 401/107 |
| 8,641,308 | B2 * | 2/2014 | Peyton | B43K 23/008 401/117 |
| 9,539,848 | B2 * | 1/2017 | Bez | B43K 24/026 |
| 2008/0095568 | A1 | 4/2008 | Hsien | |
| 2009/0290929 | A1 | 11/2009 | Rolion et al. | |
| 2010/0103653 | A1 | 4/2010 | Liu | |
| 2011/0129285 | A1 * | 6/2011 | Liu | B43K 7/12 401/117 |
| 2012/0163896 | A1 * | 6/2012 | Zhao | B43K 23/12 401/117 |

OTHER PUBLICATIONS

Extended European Search Report for European Application No. 18859709.0 dated Mar. 23, 2021 (8 pages).

* cited by examiner

RETRACTABLE NOSECONE WRITING INSTRUMENT

CROSS-REFERENCE TO RELATED APPLICATIONS

This application is a U.S. national stage application of International Application No. PCT/US2018/051793, filed Sep. 19, 2018, which claims priority benefit of U.S. Provisional Application No. 62/560,411, filed on Sep. 19, 2017, the disclosures of which are incorporated by reference herein in their entirety.

TECHNICAL FIELD

This disclosure generally relates to writing instruments, and more specifically, to a retractable nosecone writing instrument.

BACKGROUND

Writing instruments, and specifically pens, have been in widespread use for hundreds of years, with the modern ballpoint pen dating to the 1940s. Pens are typically writing instruments with an internal ink reservoir that dispenses ink on a writing surface as the pen makes contact with a substrate. Pens use various dispensing designs and inks to create a controlled ink output that does not leak ink when the pen is not in use. Ballpoint pens are commonly used, combining the internal reservoir with a dispensing tip that includes a roller ball to control the flow of ink.

To further prevent the inadvertent dispensing of ink, pens routinely come with a cap or cover to protect the dispensing tip and prevent inadvertent activation of the roller ball. Alternatively, some pens utilize a retractable tip that withdraws the dispensing tip into the body of the pen when the pen is not in use. While mechanically more complex, retractable pens have the benefit of single-piece construction which means there is no cap to lose, potentially leaving the pen more susceptible to inadvertent ink dispensing. Retractable pens also offer the possibility of single-handed use, allowing for one-handed activation, use, and retraction of the pen in a wide variety of circumstances. Various configurations have been utilized throughout the years, offering differing complexities in terms of use and the mechanisms controlling the operation of the pen. By utilizing different retraction mechanisms, manufacturers can change the ergonomics of the pen, impact the manufacturing complexity and cost, and improve the reliability of the pen.

Accordingly, a need exists to create a simple, reliable, retractable pen that overcomes one or more of the disadvantages of current designs and allows for the simple one-handed operation of the pen.

SUMMARY

In one aspect, a writing instrument is provided, including a body, a nosecone, and an adaptor. The body, nosecone, and adaptor each are of generally hollow tubular shape and have a first end and a second end. The first end of the adaptor is configured to slidably couple to the second end of the nosecone. The second end of the adaptor is coupled to the first end of the body. The writing instrument includes a writing element with a mounting end and a writing end. The mounting end of the writing element is removably coupled to the second end of the body. The writing instrument includes a locking mechanism configured to selectively lock the nosecone in a storage position and, alternatively, in a writing position. In the storage position, the nosecone is extended and covers the writing end of the writing element. In the writing position, the nosecone is retracted and the writing end of the writing element extends at least partially beyond the nosecone.

In another aspect, a writing instrument is provided, including a body, a nosecone, and an adaptor. The body, nosecone, and adaptor each are of generally hollow tubular shape and having a first end and a second end. The first end of the adaptor is coupled to the second end of the nosecone, and the second end of the adaptor is configured to slidably couple to the first end of the body. The writing instrument includes a writing element having a mounting end and a writing end. The writing element mounting end is removably coupled to the second end of the body. The writing instrument includes a locking mechanism configured to selectively lock the nosecone in a storage position and, alternatively, in a writing position. In the storage position, the nosecone is extended and covers the writing end of the writing element. In the writing position, the nosecone is retracted and the writing end of the writing element extends at least partially beyond the nosecone.

BRIEF DESCRIPTION OF THE DRAWINGS

Referring now to the drawings, which are meant to be exemplary and not limiting, and wherein like elements are numbered alike. The detailed description is set forth with reference to the accompanying drawings illustrating examples of the disclosure, in which use of the same reference numerals indicates similar or identical items. Certain embodiments of the present disclosure may include elements, components, and/or configurations other than those illustrated in the drawings, and some of the elements, components, and/or configurations illustrated in the drawings may not be present in certain embodiments.

DETAILED DESCRIPTION

Figure 1:
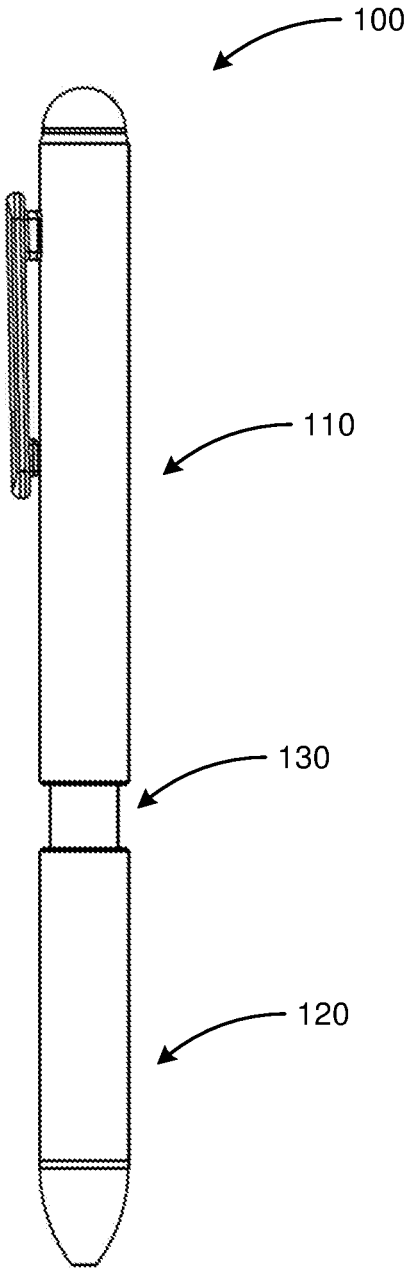
FIG. 1 is a side view of one embodiment of a writing instrument.

The retractable writing instruments described herein advantageously can accommodate various inks and writing mediums. The present disclosure includes non-limiting embodiments of retractable nosecone writing instruments, referred to generally herein as "writing instruments." The embodiments are described in detail herein to enable one of ordinary skill in the art to practice the retractable nosecone writing instruments, although it is to be understood that other embodiments may be utilized and that logical changes may be made without departing from the scope of the disclosure. Reference is made herein to the accompanying drawings illustrating some embodiments of the disclosure, in which use of the same reference numerals indicates similar or identical items. Throughout the disclosure, depending on the context, singular and plural terminology may be used interchangeably.

In certain embodiments, the retractable writing instrument includes a locking mechanism configured to selectively set the writing instrument in a writing position or a storage position. In certain embodiments, the locking mechanism includes an extension element, a plunger, and a ratchet. Further, the locking element may include one or more ribs protruding from within a writing instrument nosecone. In some instances, the extension element, plunger, and ratchet may actuate against a positioning element of a writing element to extend and retract one end of the writing element partially past one end of the nosecone (i.e., into the writing position).

As discussed herein and exemplified in certain embodiments, the writing element may be secured within a body, a nosecone, and an adaptor that is coupled between the nosecone and the body. The body may include an extension element configured to bias the writing element against the locking mechanism. As the writing element biases against the locking mechanism, the interaction between the locking mechanism and the locking element switch the writing element between the writing position and the storage position.

FIG. 1 illustrates a retractable nosecone writing instrument in accordance with one or more embodiments of the disclosure. The writing instrument 100 includes a body 110, a nosecone 120, and an adaptor 130. As shown in FIG. 1, the writing instrument 100, including the body 110, nosecone 120, and adaptor 130, may generally have a hollow tubular shape. In other embodiments, other cross-sectional geometric shapes may be employed such as triangular, square, or other polygonal shapes, each with an interior cavity that may be cylindrical, match the exterior geometry, or be another desirable geometry. Each of the body 110, nosecone 120, and adaptor 130 have a first end and a second end. In one embodiment, the first end of the adaptor connects to the second end of the nosecone, and the second end of the adaptor is configured to slidably mount to the first end of the body. Alternatively, the first end of the adaptor may be configured to slidably mount to the second end of the nosecone, and the second end of the adaptor may connect to the first end of the body. In other embodiments, individual elements may be combined into a single unitary piece; for example, the adaptor 130 and the nosecone 120 may be a single molded piece that is configured to slidably mount to the barrel 110, or in the alternative, the adaptor 130 may be combined with the barrel 110 in a single molded piece that is configured to slidably mount to the nosecone 120. As used herein, the terms "connect," "mount," "couple," and other similar terms are used broadly to refer to any suitable direct or indirect connection mechanism.

Figure 2:
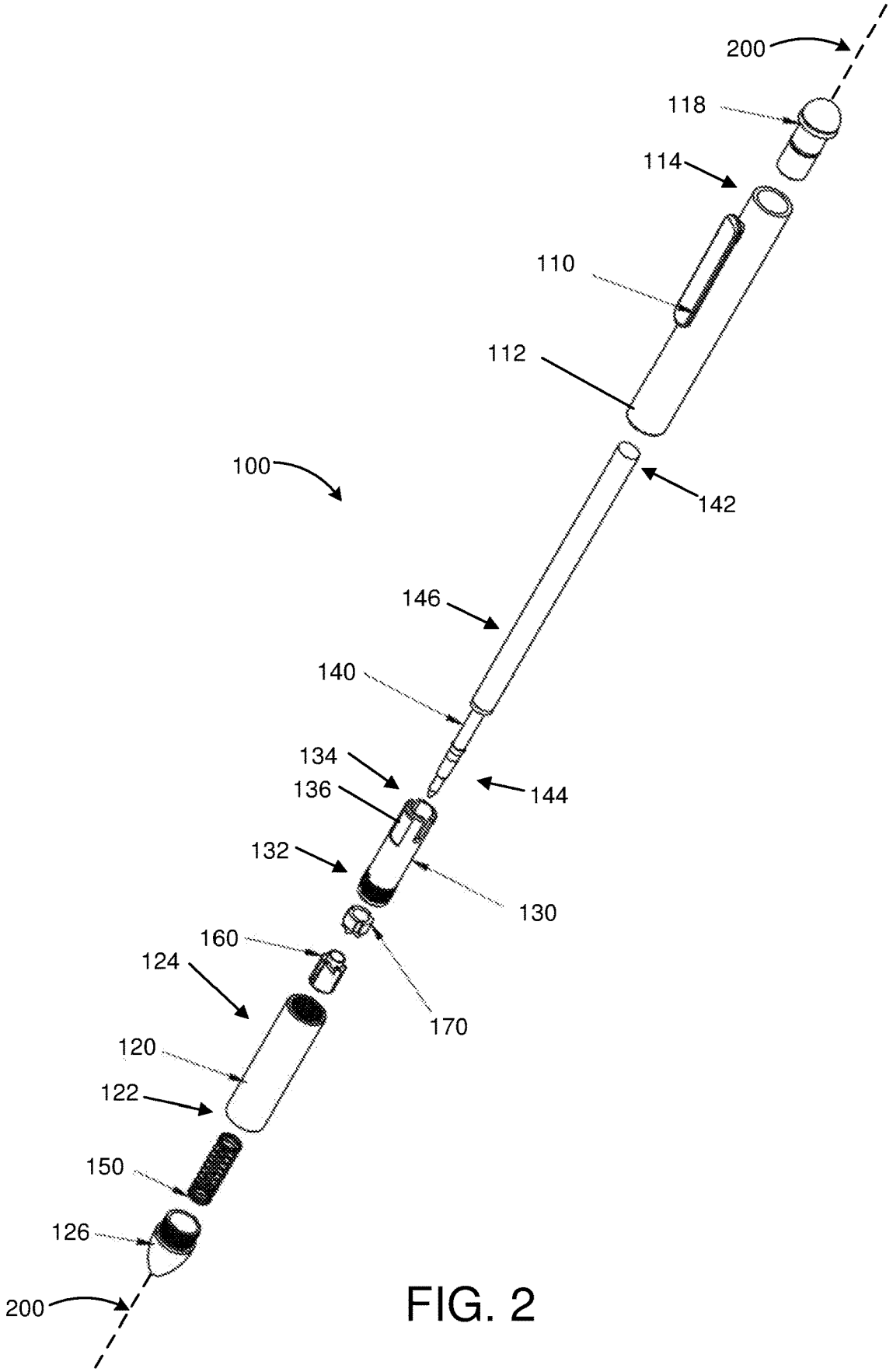
FIG. 2 is an exploded view of the writing instrument of FIG. 1.
Figure 10A:
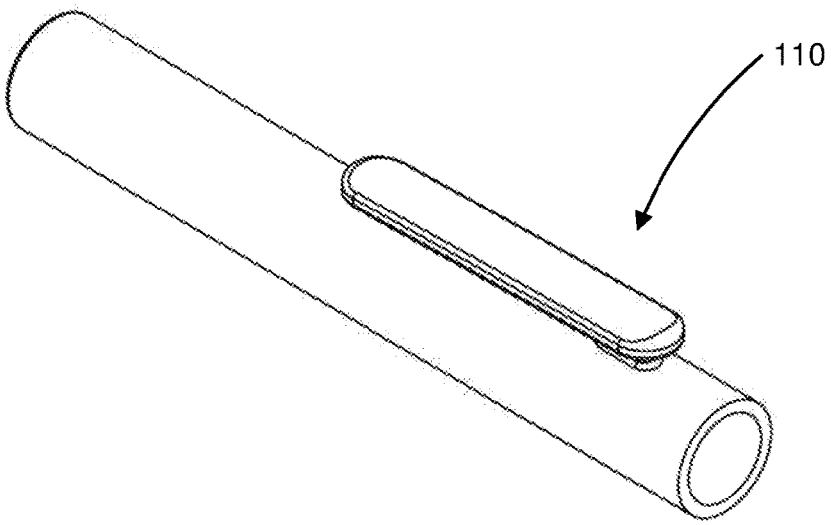
FIG. 10A is perspective view of one embodiment of a body of the writing instrument of FIG. 1.
Figure 10B:
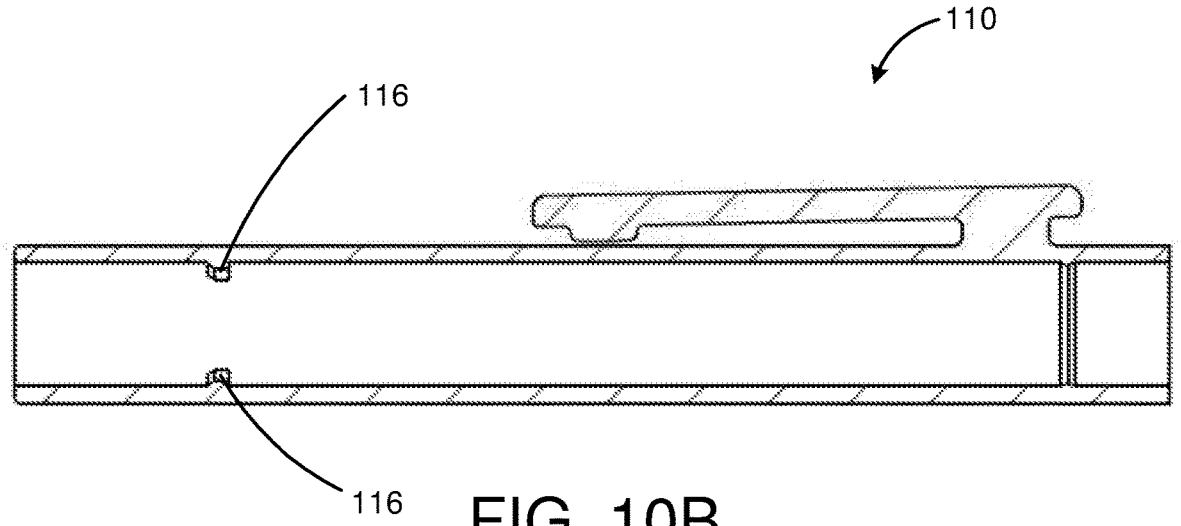
FIG. 10B is a cross-sectional view of the body of FIG. 10A.

FIG. 2 illustrates an exploded assembly view of the writing instrument 100. As shown in FIG. 2, in one embodiment, the outer diameter of the adaptor 130 approximately corresponds to the inner diameter of the nosecone 120. The nosecone 120 and adaptor 130 may be joined using several different means depending on the specific embodiment; the mating ends may be press fit, use an adhesive joint, be ultrasonically or thermally welded, may have mating threads, or may have features that snap together. Also as shown in FIG. 2, the outer diameter of the adaptor 130 approximately corresponds with the inner diameter of the body 110. The adaptor may have a first adaptor end 132 and a second adaptor end 134 and be dimensioned to slide smoothly within the body 110, allowing the adaptor 130 to extend from and retract within the body 110 along the longitudinal axis of the writing instrument. In some embodiments, the adaptor 130 may elastically deform upon assembly with the body, so that once assembled, the adaptor will not disconnect or de-couple from the body 110. In other instances, the adaptor 130 may disconnect or de-couple from the body 110. Similarly, in some embodiments, the body 110 may include internal ledges 116 (as shown in FIG. 10B), ribs, or other geometries that control how far the adaptor 130 may be retracted or extended into the body 110. In one embodiment, as illustrated in FIG. 2, a recess 136 is disposed in the second adaptor end 134 of the adaptor 130. This recess mates with the ledge 116 in the first end of the body 110, preventing removal of the adaptor 130 from the body 110 and limiting the insertion of the adaptor 130 into the body 110.

As shown in FIG. 2, the writing instrument 100 further comprises a writing element 140. The writing element may be a generally tubular shape as shown, or may take another polygonal shape that may or may not match the general geometric shape of the body 110 and nosecone 120. The writing element 140 may have a mounting end 142 and a writing end 144. The mounting end 142 may be removably coupled to the second end of the body 110. The writing element 140 may be coupled to the body 110 by use of a press fit, threaded engagement, snap fittings, or other suitable connection method. In one embodiment, the writing element 140 may be a ballpoint pen ink cartridge, comprising an ink reservoir and a ballpoint tip assembly. In some embodiments, the writing element 140 may comprise a thermochromic ink.

The nosecone 120 may have a first nosecone end 122 and a second nosecone end 124. In some embodiments, the first nosecone end 122 transitions to a conical or bullet shaped tip 126. In some embodiments, the tip 126 is integrated into the nosecone, which is manufactured or molded as a single component, while in other embodiments, as illustrated in FIG. 2, the tip 126 is a separate component that may either be removably attached to the nosecone 120 with, for example, mating threads, or it may be fixed to the nosecone 120 by adhesive, press or snap fit, ultrasonic or thermal welding, or other suitable means.

Figure 3:
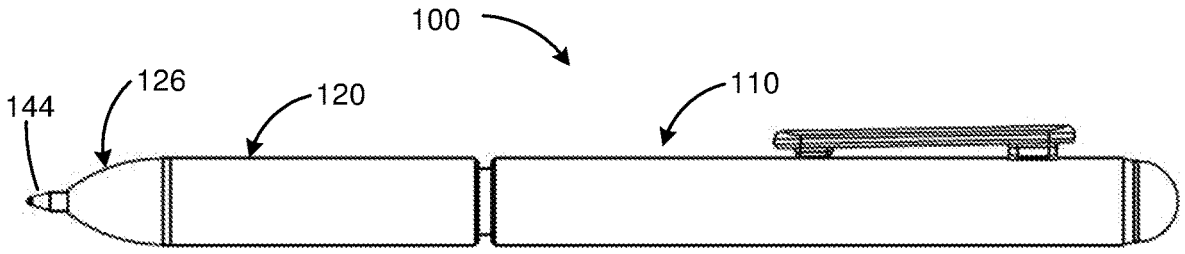
FIG. 3 is a side view of the writing instrument of FIG. 1 in a writing position.
Figure 4:
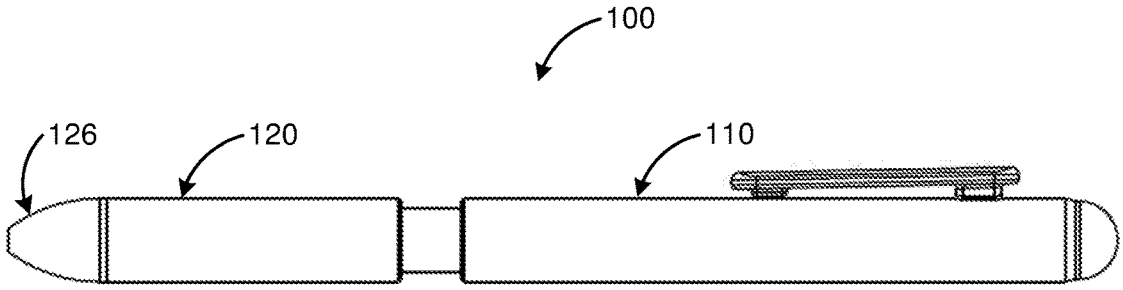
FIG. 4 is a side view of the writing instrument of FIG. 1 in a storage position.

The writing instrument also includes a locking mechanism. The locking mechanism may be configured to selectively lock the nosecone 120 in a protracted storage position and a retracted writing position. When the nosecone 120 is in the writing position, the nosecone 120 is retracted and the writing end 144 of the writing element 140 extends at least partially beyond the nosecone 120, as shown in FIG. 3. When the nosecone 120 is in the storage position, the nosecone 120 is extended and covers the writing end 144 of the writing element 140 as shown in FIG. 4.

Figure 5A:
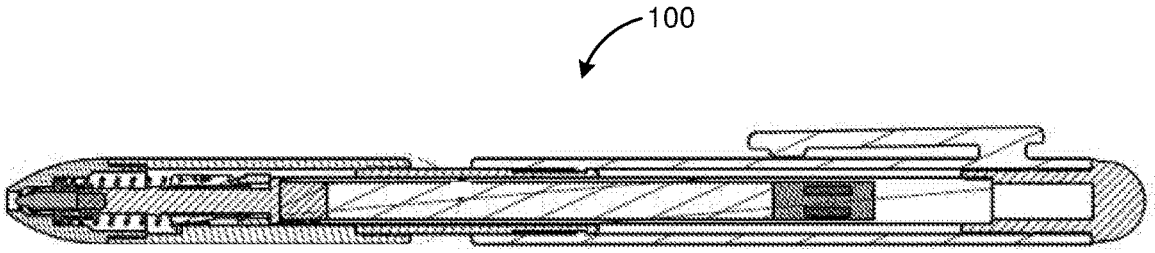
FIG. 5A is a cross-sectional view of the writing instrument of FIG. 1 in a storage position.
Figure 5B:
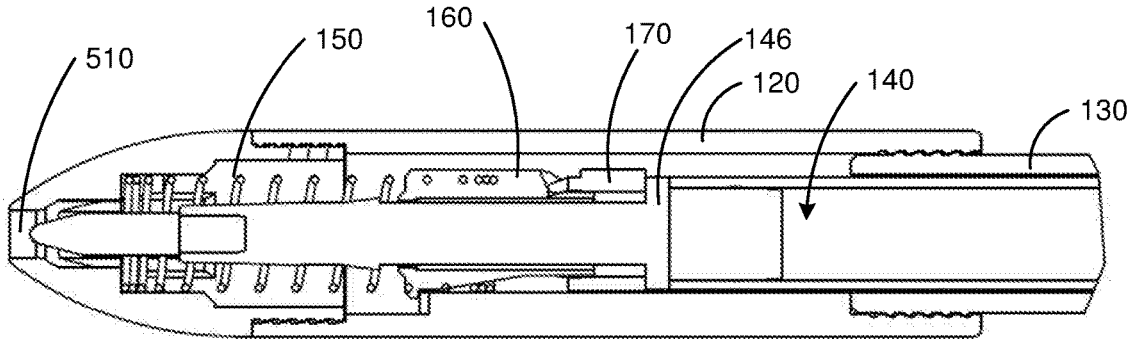
FIG. 5B is a cross-sectional magnified view of the writing instrument of FIG. 1 in a storage position.
Figure 6A:
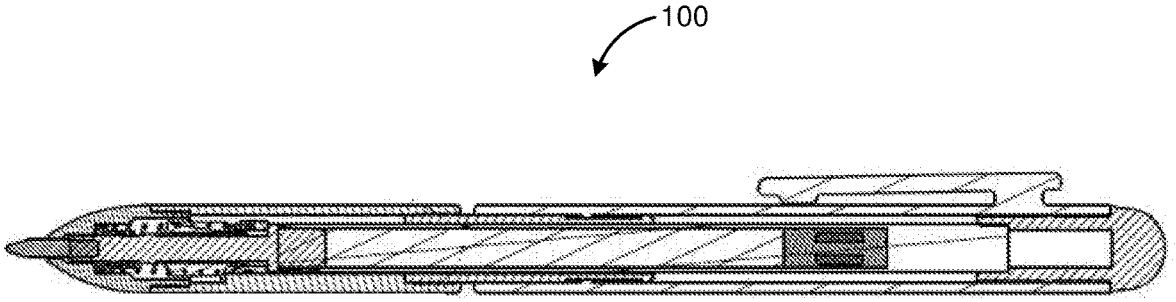
FIG. 6A is a cross-sectional view of the writing instrument of FIG. 1 in a writing position.
Figure 6B:
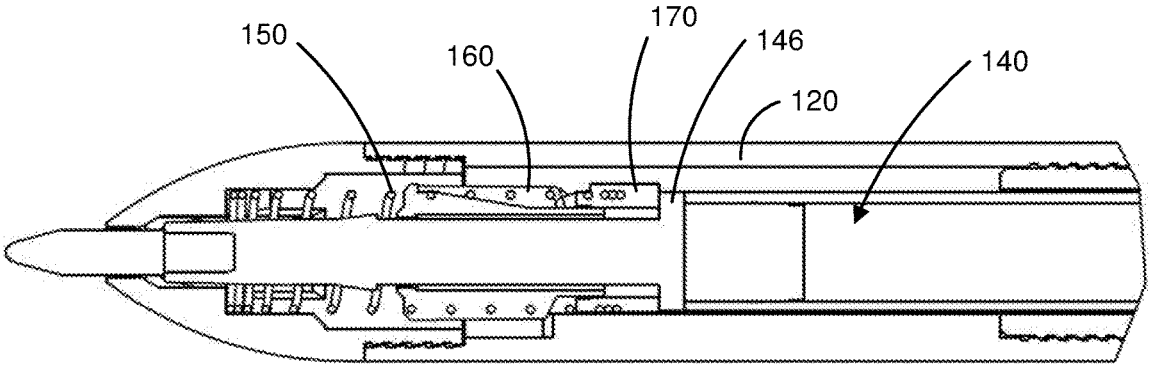
FIG. 6B is a cross-sectional magnified view of the writing instrument of FIG. 1 in a writing position.

With the writing instrument 100 in the storage position, and because the writing element 140 is coupled to the body 110 of the writing instrument 100, the user cycles the locking mechanism by applying a retracting force on the nosecone 120, causing the nosecone 120 and adaptor 130 to slide rearward towards the body 110 of the writing instrument. Once the locking mechanism is cycled fully, the nosecone 120 and adaptor 130 will lock in the writing position. When the user cycles the locking mechanism again, by applying a retracting force on the nosecone 120, causing the nosecone 120 and adaptor 130 to slide rearward towards the body 110 of the writing instrument again, the locking mechanism will cycle, allowing the nosecone 120 and adaptor to slide forward into the storage position. FIG. 5A shows a section view of the writing instrument 100 in the storage position, and FIG. 5B shows a detailed section view of the locking mechanism in the storage position. FIG. 6A shows a section view of the writing instrument 100 in the writing position, and FIG. 6B shows a detailed section view of the locking mechanism in the writing position.

In some embodiments, the writing element 140 also includes a positioning element 146. As shown in FIGS. 5B and 6B, the positioning element 146 may be a stepped increase in the diameter of the writing element 140. In other embodiments, the positioning element 146 may be a shelf that protrudes radially outward around the circumference of the writing element 140.

In one embodiment, as shown in FIG. 2, and in more detail in FIGS. 5A and B, and 6A and B, the locking mechanism may include an extension element 150, a plunger 160, and a ratchet 170. The extension element 150, plunger 160, and ratchet 170 may all be configured to slide over a portion of the writing element 140 and fit inside the nosecone 120. In some embodiments, the extension element 150 applies a force, along a longitudinal axis 200 of the writing instrument 100, to the nosecone 120 which biases the nosecone 120 away from the body 110. The extension element 150 may also apply a force, along the longitudinal axis 200 of the writing instrument 100, to the plunger 160 and ratchet 170, biasing the plunger 160 against the ratchet 170, and the plunger 160 and ratchet 170 against the writing element 140 positioning element 146, the positioning element 146 limiting the longitudinal motion of the plunger 160 and ratchet 170. In one embodiment, as shown in FIG. 2, the extension element 150 may be a compression spring. The compression spring may fit over the writing element 140 and inside the nosecone 120. In some embodiments, the interior surface of the nosecone 120 is configured to capture the spring and provide a flat surface for the spring to rest against.

Figure 7A:
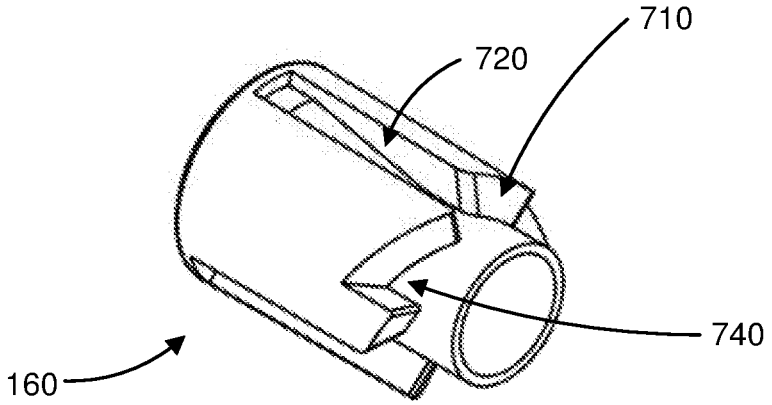
FIG. 7A is a perspective view of one embodiment of a plunger of the writing instrument of FIG. 1.
Figure 7B:
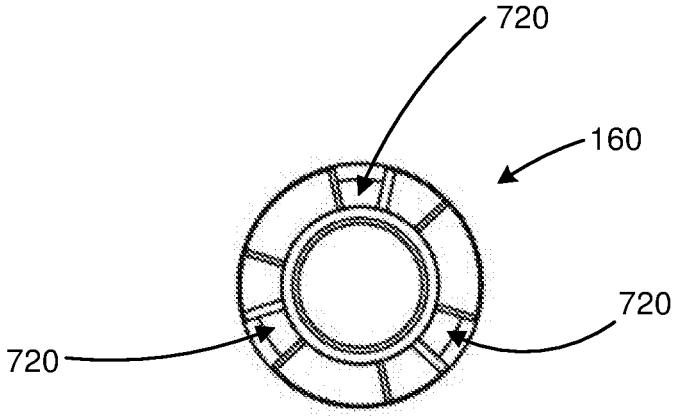
FIG. 7B is a top view of the plunger of FIG. 7A.
Figure 8A:
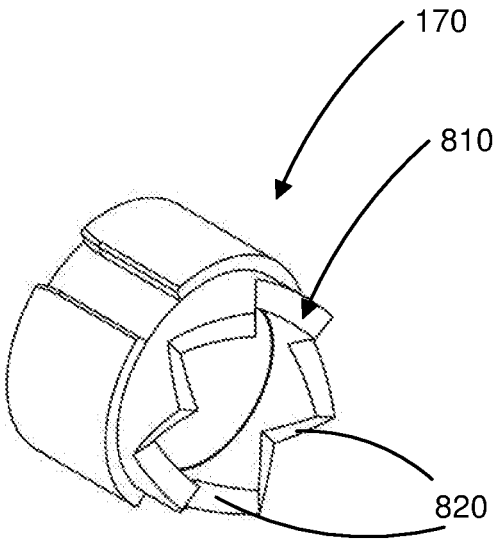
FIG. 8A is a perspective view of one embodiment of a ratchet of the writing instrument of FIG. 1.
Figure 8B:
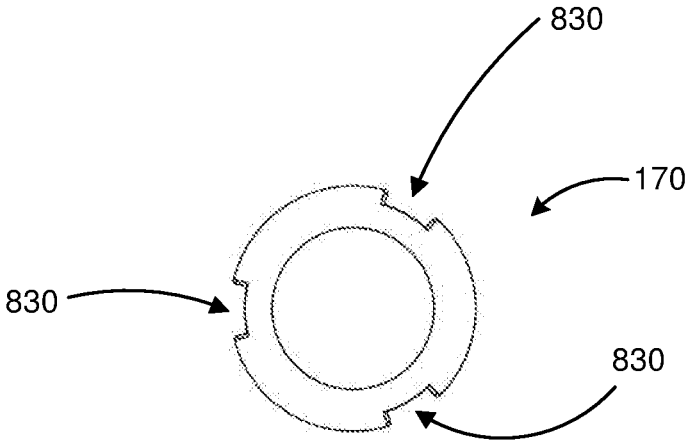
FIG. 8B is a top view of the ratchet of FIG. 8A.

FIG. 7A shows an isometric view of, and FIG. 7B shows an end view of, one embodiment of a plunger 160 in accordance with the disclosure. As shown, the plunger 160 includes a ratchet mating surface 710. Similarly, FIG. 8A shows and isometric view of, and FIG. 8B shows an end view of, one embodiment of a ratchet 170, including a plunger mating surface 810. The ratchet mating surface 710 may include a plurality of teeth 740 or notches that are configured to mate with a corresponding plurality of teeth 820 or notches in the plunger mating surface 810. These mating surfaces are configured to allow for the selective rotation of the ratchet 170 and plunger 160 with respect to each other around the longitudinal axis 200 of the writing instrument 100. By varying the shape and spacing of the mating surfaces, the force required to rotate the components may be altered, as well as the degrees of rotation allowed with each cycle of the locking mechanism.

In one embodiment, when the extension element 150 is compressed by the user, as described above, the extension element 150 applies a longitudinal force on the plunger 160 and the ratchet 170. The longitudinal force biases the ratchet mating surface 710 and the plunger mating surface 810 into contact, and the resulting normal force acting on the mating surfaces causes them to rotate around the longitudinal axis 200 of the writing instrument 100, until the teeth interlock, preventing further rotation. This causes the plunger 160 to rotate from a first position to a second position.

Figure 9A:
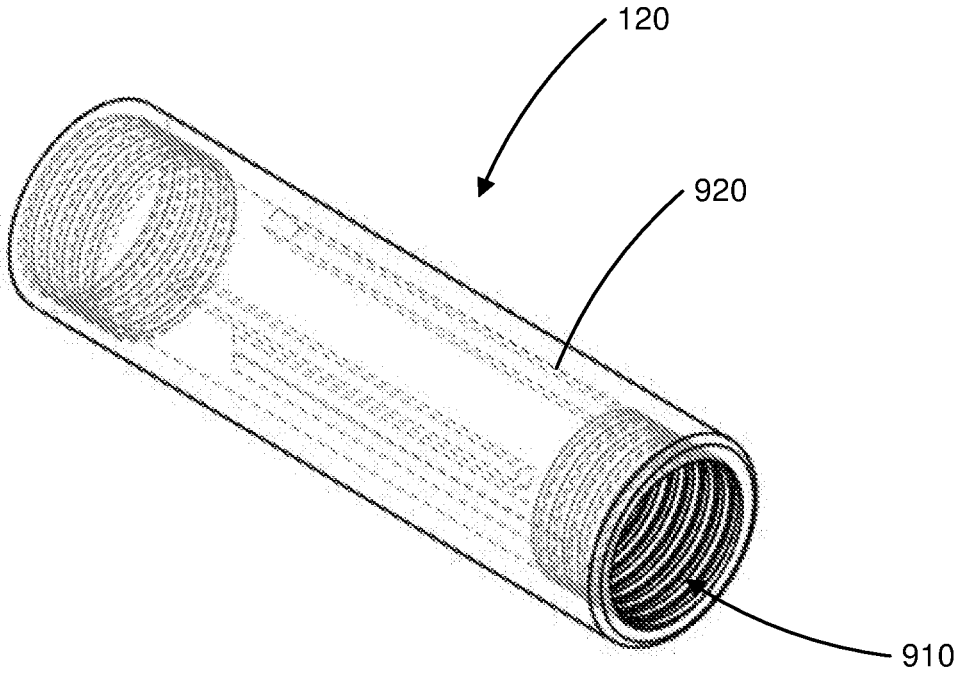
FIG. 9A is a perspective view of one embodiment of a nosecone of the writing instrument of FIG. 1.
Figure 9B:
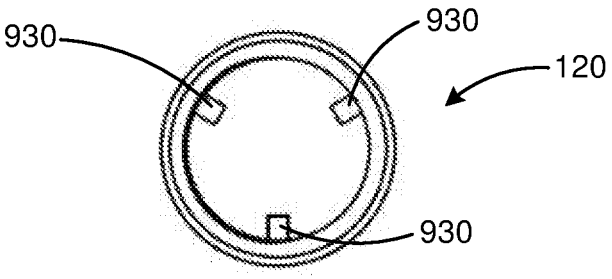
FIG. 9B is a top view of the nosecone of FIG. 9A.

FIG. 9A shows an isometric view with hidden lines of, and FIG. 9B shows an end view of, a nosecone 120, in accordance with one embodiment of the disclosure. As shown, the nosecone 120 includes an inner surface 910 and an outer surface 920. In one embodiment, the nosecone includes a locking element 930. As shown in FIG. 9B, the locking element 930 may include one or more ribs protruding inward from the inner surface 910 of the nosecone 120, and extending longitudinally down at least a portion of the length of the inner surface 910 of the nosecone 120. In some embodiments, the locking element 930 is configured to selectively mate with the locking mechanism to prevent rotational and longitudinal movement of the locking mechanism, and more specifically, the plunger 160 and ratchet 170 components of the locking mechanism.

In some embodiments, as shown in FIGS. 7A and 7B, the plunger 160 includes at least one guide channel 720, running longitudinally down a portion of the length of an outer surface of the plunger 160. Similarly, in some embodiments, as shown in FIGS. 8A and 8B, the ratchet includes at least one guide channel 830, running longitudinally down a portion of the length of an outer surface of the ratchet 170. In these embodiments, the plunger guide channel 720 and ratchet guide channel 830 may be configured to receive the nosecone 120 locking element 930 when the locking element 930, plunger guide channel 720, and ratchet guide channel 830 are aligned. In some instances, the plunger 160 includes three guide channels 720 located 120 degrees apart. In other instances, the plunger 160 includes two guide channels 720 located 180 degrees apart. The plunger 160 may have any number of guide channels located at varying distances around the plunger 160.

When the plunger guide channel 720 and ratchet guide channel 830 are aligned with the nosecone 120 locking element 930, the guide channels allow the nosecone 120 to move longitudinally forward towards the storage position (because the locking element 930 can pass through the plunger guide channel 720 and the ratchet guide channel 830). When the plunger guide channel 720 is not aligned with the nosecone 120 locking element 930, the nosecone 120 is constrained from moving forward because the locking element 930 interferes with the plunger 160 in the absence of the plunger guide channel 720 pathway, locking the nosecone 120 in the writing position. In some embodiments, as shown in FIG. 7B, the plunger 160 may contain two or more guide channels 720, spaced evenly around the perimeter of the plunger 160.

Figure 11A:
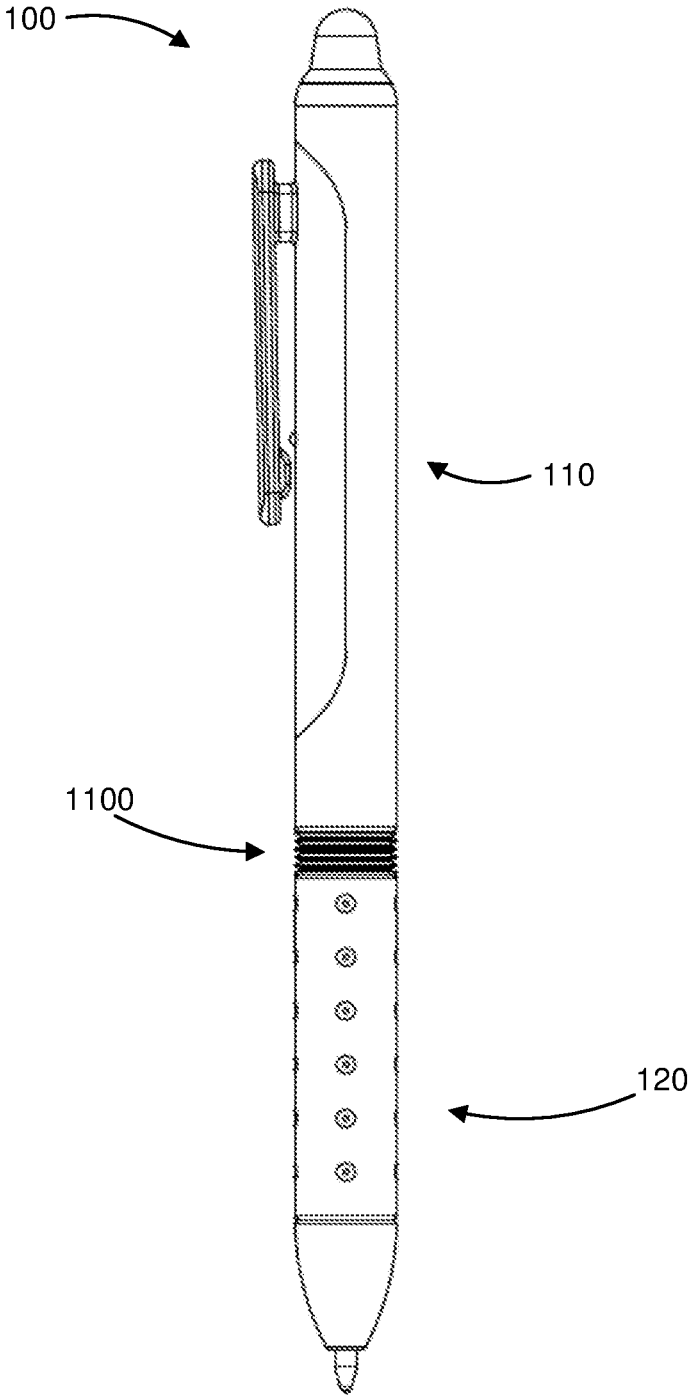
FIG. 11A is a front view of one embodiment of a writing instrument in a writing position.
Figure 11B:
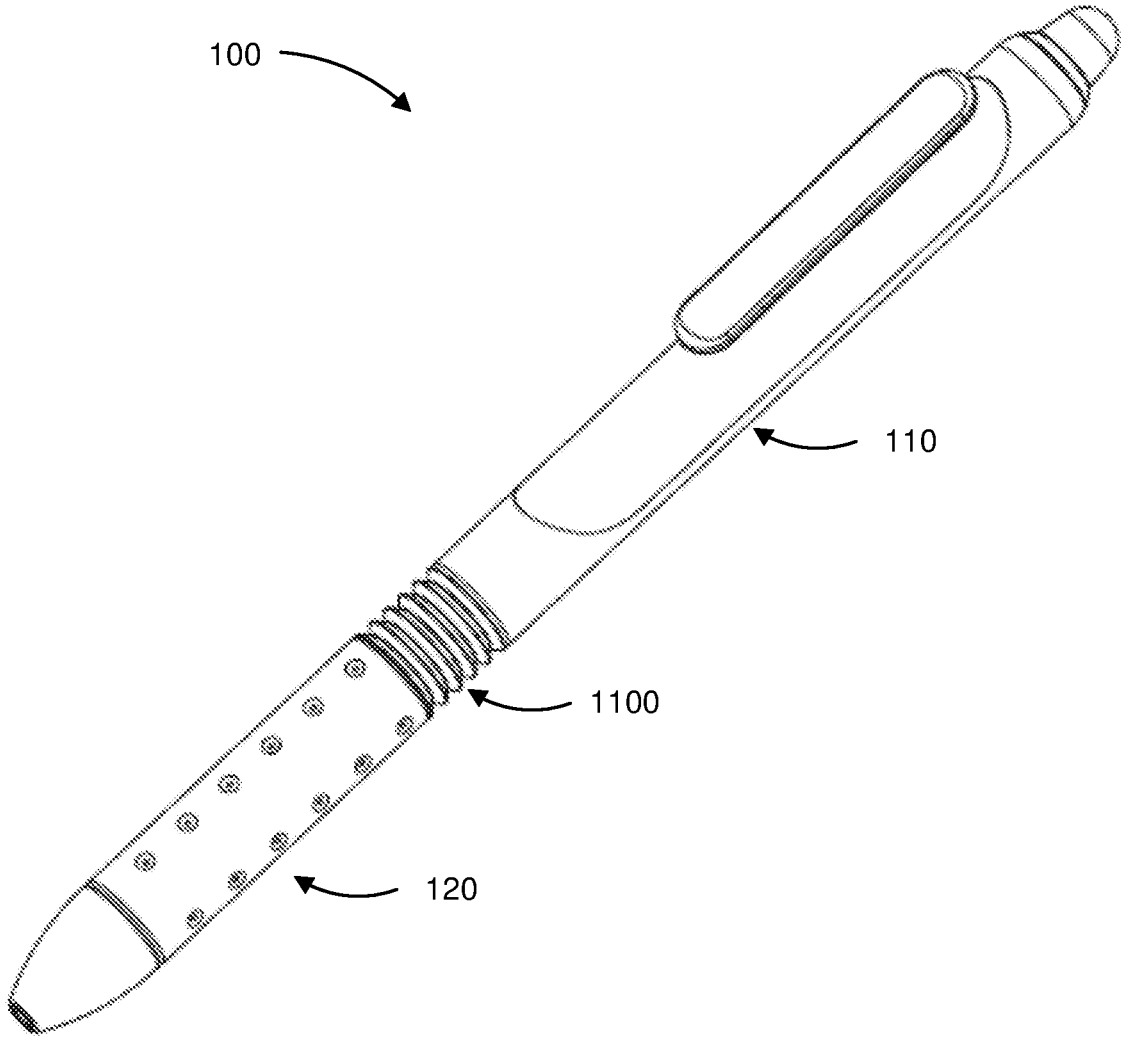
FIG. 11B is a perspective view of the writing instrument of FIG. 11A in a storage position.

In one embodiment, as shown in FIGS. 11A and 11B, the adaptor 130 may be covered by a sleeve 1100. In another embodiment, the sleeve 1100 may cover the writing element or another internal component of the writing instrument 100. The sleeve 1100 may be a flexible or semi-rigid plastic, rubber, or other suitable material that expands and contracts to substantially cover the adaptor 130 where it is visible between the body 110 and nosecone 120. In some embodiments, the sleeve 1100 is formed in the shape of a collapsible, cylindrical, bellows as shown in FIG. 11A.

In another embodiment, at least one locking notch 740 is included on the plunger 160. As the guide channel 720 may receive the locking element 930 when the writing instrument is in the storage position, the locking notch 740 may correspond with the rotation of the guide channel 720 when in the writing position, allowing the locking element 930 to additionally prevent unwanted rotation of the plunger 160 when the writing instrument is in the storage position.

In some instances, as shown in FIG. 7A, the extension element 150 at rest applies force longitudinally forwards (away from the body 110) on the nosecone 120 and longitudinally rearward (toward the body 110) the plunger 160 and ratchet 170. The axial force biases the plunger 160 and ratchet 170 against the positioning element 146. With the writing instrument 100 starting in the storage position, as the user moves the nosecone 120 rearward, the compression mechanism compresses further, increasing the force applied to the plunger 160. The nosecone 120 and locking element 930 slide rearward relative to the stationary writing element 140, ratchet 170 and plunger 160. When the locking element 930 is in the guide channel 720, it prevents the plunger 160 from rotating. As the nosecone 120 and locking element 930 slide rearward, the locking element 930 eventually slides out of the guide channel 720 in the plunger 160, at which point the rotational motion created by the longitudinal force applied to the ratchet 170 and plunger 160 by the increased compression in the extension element 150 causes the plunger 160 to rotate until the mating surfaces of the plunger 160 and the ratchet 170 interlock. When the user removes the force on the nosecone 120, the extension element 150 pushes the nosecone 120 away from the body 110 and the plunger rotates again until the locking notch 740 in the plunger 160 mates with the locking element 930.

To cycle the writing instrument 100 from the writing position back to the storage position, the user again moves the nosecone 120 rearward. Once the locking element 930 exits the locking notch 740, the compression of the extension element 150 again applies a longitudinal force to the plunger 160, causing it to rotate. When the user removes the force from the nosecone 120, the extension element 150 pushes the nosecone 120 away from the body, but, with the locking element 930 aligned with the guide channel 720, the nosecone 120 can extend fully to the storage position.

In yet another embodiment of the disclosure, as shown in FIGS. 2 and 5B, the writing instrument includes a body 110, a writing element 140, a nosecone 120, and a locking mechanism. In this embodiment, the body 110 may be generally tubular in shape with a body first end 112 and a body second end 114. The writing element may include a writing end 144 and a mounting end 142, the mounting end 142 being removably coupled to the body second end 114. The nosecone 120 may be generally tubular in shape and include a nosecone first end 122 and a nosecone second end 124. The nosecone first end 124 may include an aperture 510 that is configured to allow the writing end 144 of the writing assembly 140 to extend through the nosecone first end 122, and the nosecone second end 124 may be configured to slidably couple to the body first end 112. In one embodiment, the locking mechanism may be configured to selectively lock the nosecone 120 in an extended position, covering the writing end 144 of the writing element 140, and a retracted position, exposing the writing end 144 of the writing element 140. In some instances, the body second end 114 may be attached to an end cap 118. That is, an end cap 118 may be a hollow cylinder with an open end and a closed end. In this manner, the end cap 118 may slidably connect to the body second end 114 to protect the mounting end 142 of the writing element 140. In some instances, the end cap 118 may attach to the mounting end 142.

In another embodiment, as shown in FIGS. 5A-6B, the writing instrument 100 may include a body 110 and a nosecone 120. The body 110 and the nosecone 120 may be tubular and slidably connected to each other. The body 110 may also include a writing assembly 140, the writing assembly 140 being removably fixed to the body 110. The writing instrument 100 may include a locking mechanism that is configured to selectively lock the nosecone 120 in a first position and a second position. When the nosecone 120 is in the first position, the nosecone 120 may be extended in a storage position. When the nosecone 120 is in the second position, the nosecone 120 may be retracted in a writing position and the writing assembly 140 may extend at least partially beyond the nosecone 120 (i.e., beyond the nosecone 120 and/or a tip 126 thereof). Additional embodiments may utilize different combinations of geometries and elements, or utilize different geometries to create and cycle the locking mechanism.

Figure 12:
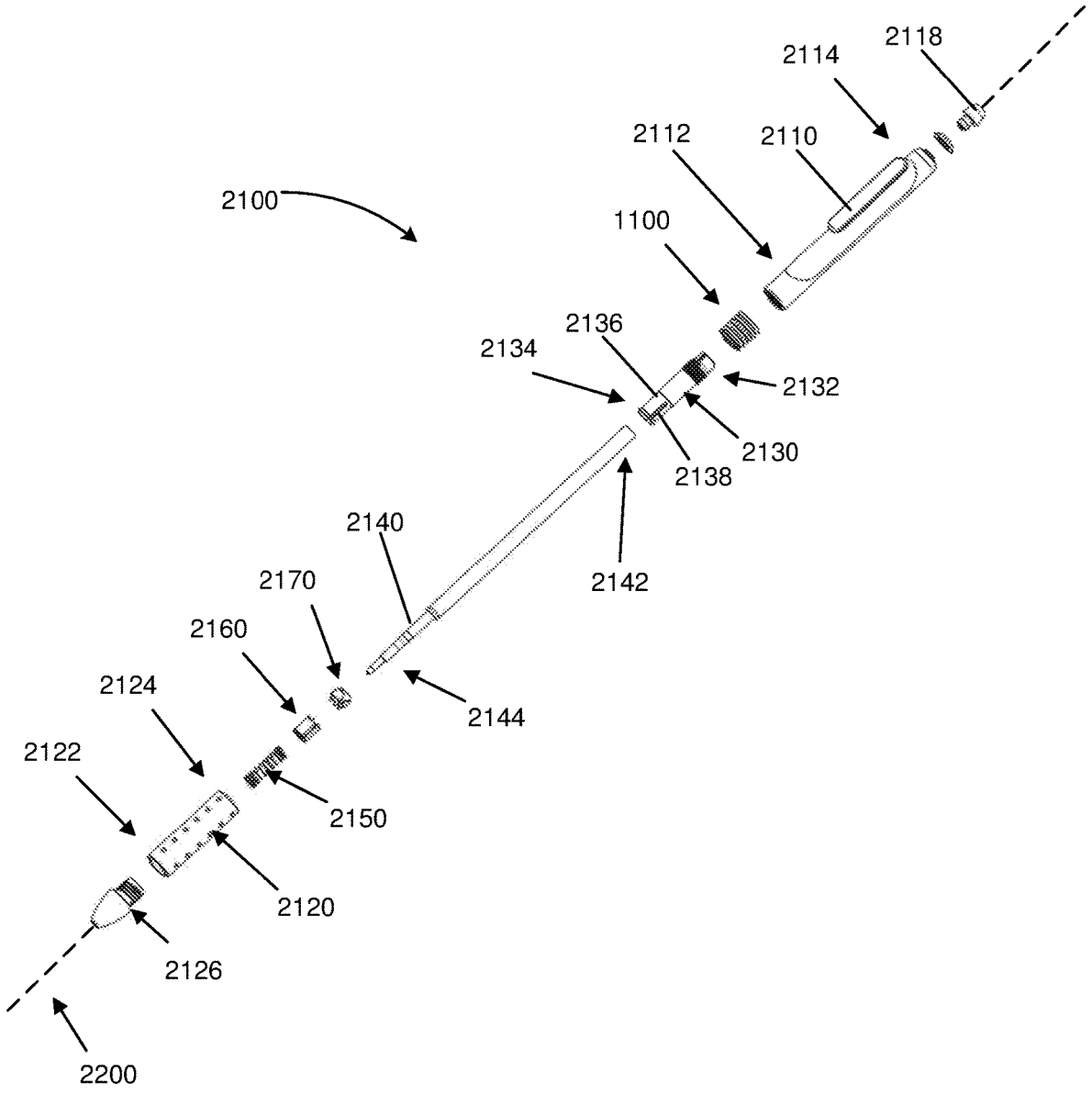
FIG. 12 is an exploded view of the writing instrument of FIG. 11A.

FIGS. 12-20 illustrate a retractable nosecone writing instrument 2100 in accordance with one or more embodiments of the disclosure. The writing instrument 2100 includes a body 2110, a nosecone 2120, and an adaptor 2130 (not shown). As shown in FIG. 12, the writing instrument 2100, including the body 2110, nosecone 2120, and adaptor 2130, may generally have a hollow tubular shape. In other embodiments, other cross-sectional geometric shapes may be employed such as triangular, square, or other polygonal shapes, each with an interior cavity that may be cylindrical, match the exterior geometry, or be another desirable geometry. Each of the body 2110, nosecone 2120, and adaptor 2130 have a first end and a second end. In one embodiment, the first end 2134 of the adaptor 2130 may be configured to slidably mount to the second end 2124 of the nosecone 2120, and the second end 2132 of the adaptor 2130 may connect to the first end 2112 of the body 2110. In other embodiments, individual elements may be combined into a single unitary piece; for example, the adaptor 2130 and the nosecone 2120 may be a single molded piece that is configured to slidably mount to the body 2110, or in the alternative, the adaptor 2130 may be combined with the body 2110 in a single molded piece that is configured to slidably mount to the nosecone 2120. In some instances, the nosecone 2120 may be composed of a soft material (e.g., polyurethane). In other instances, the nosecone 2120 may be composed of a hard material.

FIG. 12 illustrates an exploded assembly view of the writing instrument 2100. As shown in FIG. 12, in one embodiment, the outer diameter of the adaptor 2130 approximately corresponds to the inner diameter of the body 2110. The body 2110 and adaptor 2130 may be joined using several different means depending on the specific embodiment; the mating ends may be press fit, use an adhesive joint, be ultrasonically or thermally welded, may have mating threads, or may have features that snap together. Also as shown in FIG. 12, the outer diameter of the adaptor 2130 approximately corresponds with the inner diameter of the nosecone 2120. The adaptor may have a first adaptor end 2134 and a second adaptor end 2132 and be dimensioned to slide smoothly within the nosecone 2120, allowing the adaptor 2130 to extend from and retract within the nosecone 2120 along the longitudinal axis of the writing instrument. In some embodiments, the adaptor 2130 may elastically deform upon assembly with the body, so that once assembled, the adaptor will not disconnect or de-couple from the nosecone 2120. In other instances, the adaptor 2130 may disconnect or de-couple from the nosecone 2110. Similarly, in some embodiments, the nosecone 2120 may include internal ledges 2116 (as shown in FIG. 18B), ribs, or other geometries that control how far the adaptor 2130 may be retracted or extended into the nosecone 2120. In one example, as illustrated in FIGS. 12, 14B, and 15A-15E, a recess 2136 in the first adaptor end 2134 of the adaptor 2130, this recess 2136 mates with the ledge 2116 in the second end 2124 of the nosecone 2120, preventing removal of the adaptor 2130 from the nosecone 2120 and limiting the insertion of the adaptor 2130 into the nosecone 2120.

As shown in FIG. 12, the writing instrument 2100 further comprises a writing element 2140. The writing element may be a generally tubular shape as shown, or may take another polygonal shape that may or may not match the general geometric shape of the body 2110 and nosecone 2120. The writing element 2140 may have a mounting end 2142 and a writing end 2144. The mounting end 2142 may be removably coupled to the second end 2114 of the body 2110. The writing element 2140 may be coupled to the body 2110 by use of a press fit, threaded engagement, snap fittings, or other suitable connection method. In one embodiment, the writing element 2140 may be a ballpoint pen ink cartridge, comprising an ink reservoir and a ballpoint tip assembly. In some embodiments, the writing element 2140 may comprise a thermochromic ink.

The nosecone 2120 may have a first nosecone end 2122 and a second nosecone end 2124. In some embodiments, the first nosecone end 2122 transitions to a conical or bullet shaped tip 2126. In some embodiments, the tip 2126 is integrated into the nosecone 2120, which is manufactured or molded as a single component, while in other embodiments, as illustrated in FIG. 12, the tip 2126 is a separate component that may either be removably attached to the nosecone 2120 with, for example, mating threads, or it may be fixed to the nosecone 2120 by adhesive, press or snap fit, ultrasonic or thermal welding, or other suitable means.

Figure 13A:
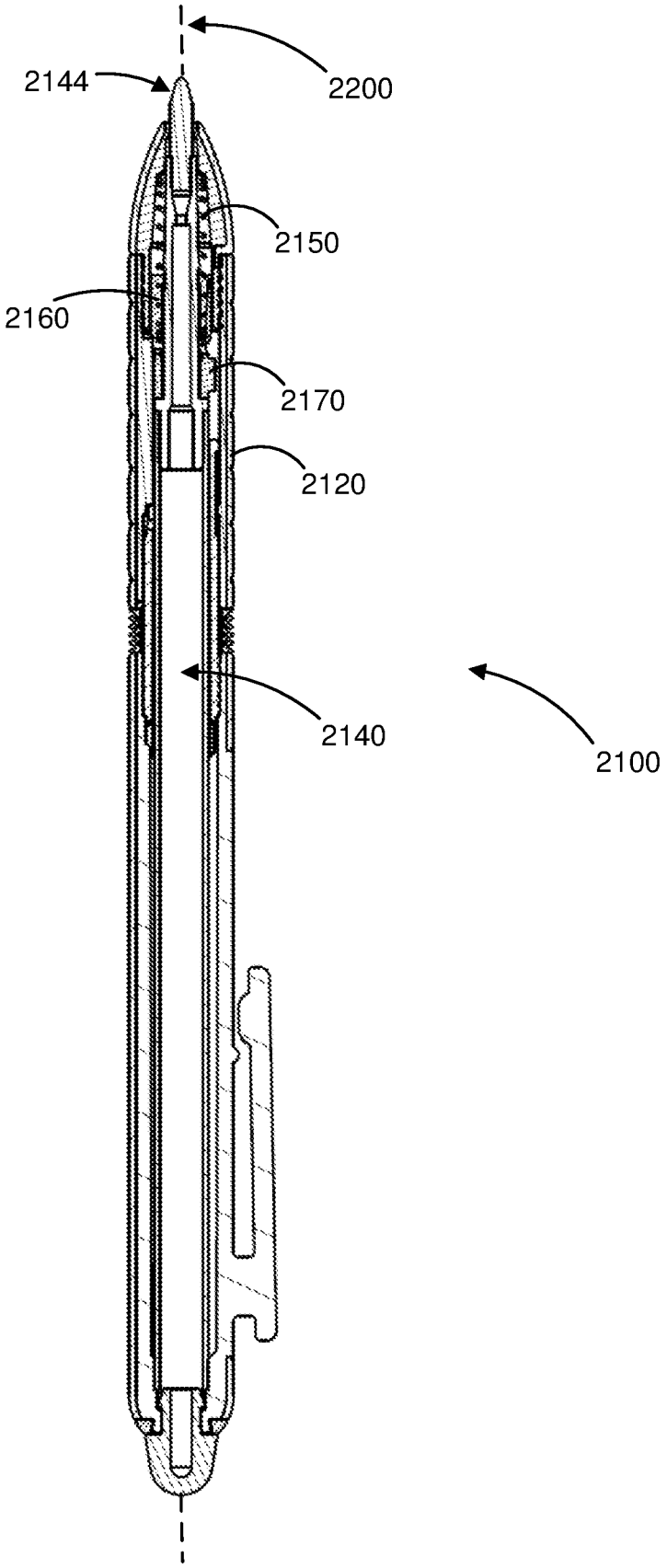
FIG. 13A is a cross-sectional view of the writing instrument of FIG. 11A in a writing position.
Figure 14A:
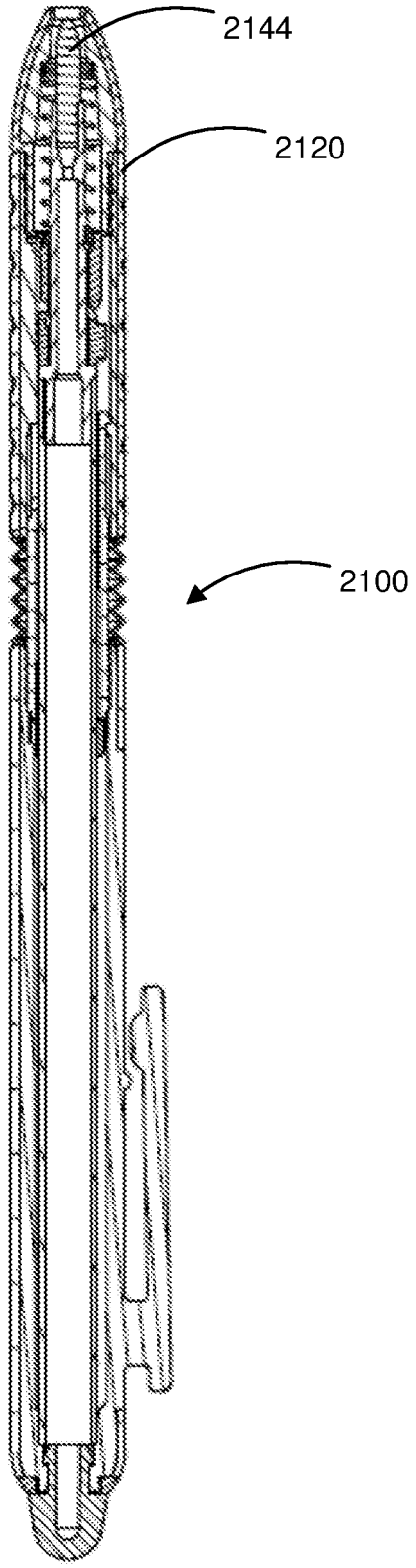
FIG. 14A is a cross-sectional view of the writing instrument of FIG. 11A in a storage position.

The writing instrument also includes a locking mechanism. The locking mechanism may be configured to selectively lock the nosecone 2120 in a protracted storage position and a retracted writing position. When the nosecone 2120 is in the writing position (e.g., as shown in FIG. 13A), the nosecone 2120 is retracted and the writing end 2144 of the writing element 2140 extends at least partially beyond the nosecone 2120 (i.e., beyond the nosecone 2120 and/or a tip 2126 thereof). When the nosecone 2120 is in the storage position (e.g., as shown in FIG. 14A), the nosecone 2120 is extended and covers the writing end 2144 of the writing element 2140.

Figure 13B:
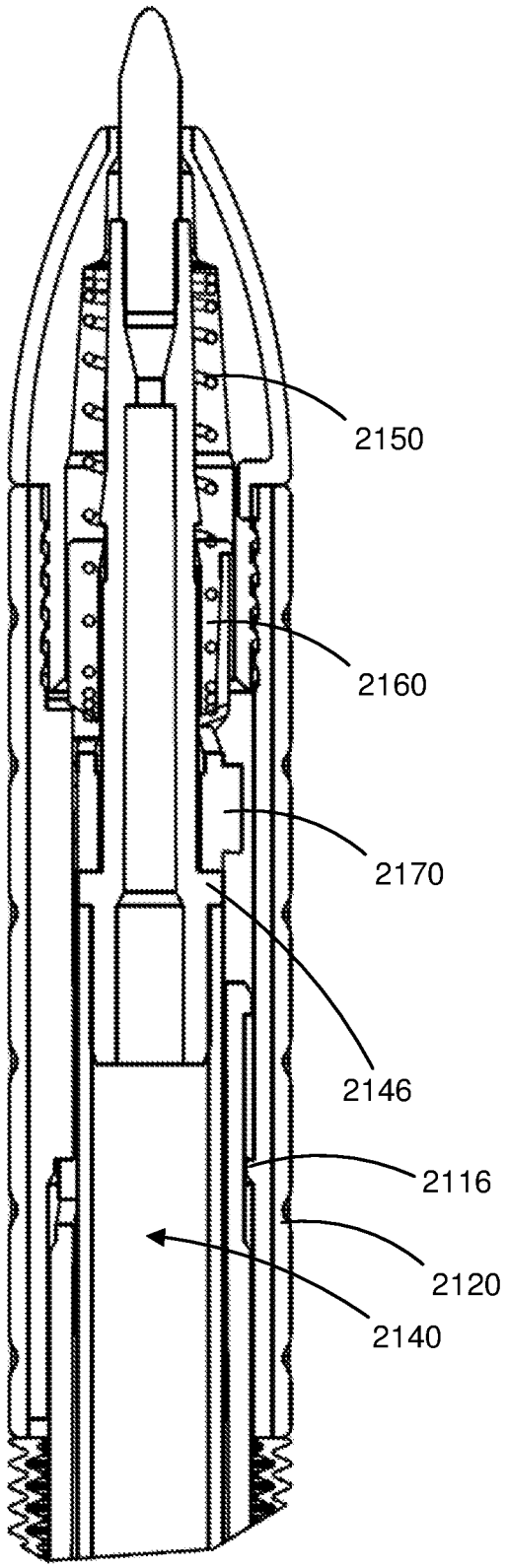
FIG. 13B is a cross-sectional magnified view of the writing instrument of FIG. 11A in a writing position.
Figure 14B:
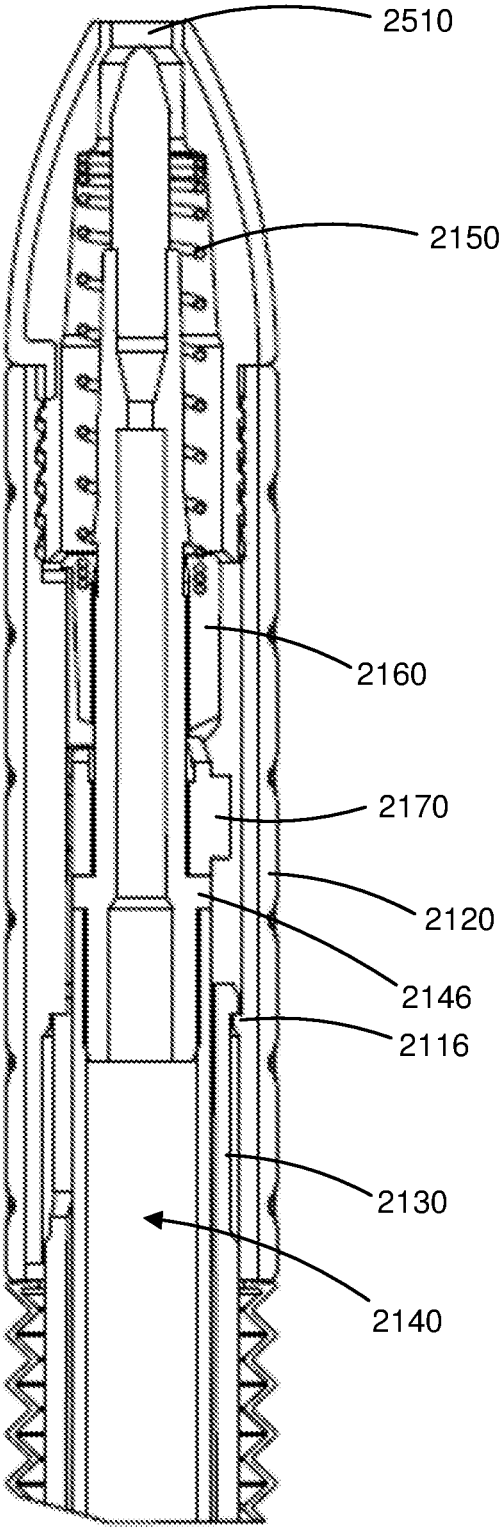
FIG. 14B is a cross-sectional magnified view of the writing instrument of FIG. 11A in a storage position.
Figure 15A:
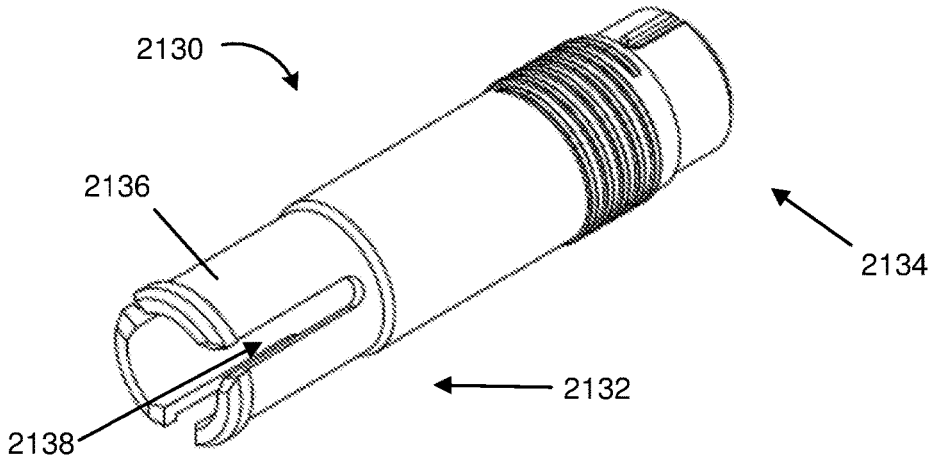
FIG. 15A is a perspective view of one embodiment of an adaptor of the writing instrument of FIG. 11A.
Figure 15B:
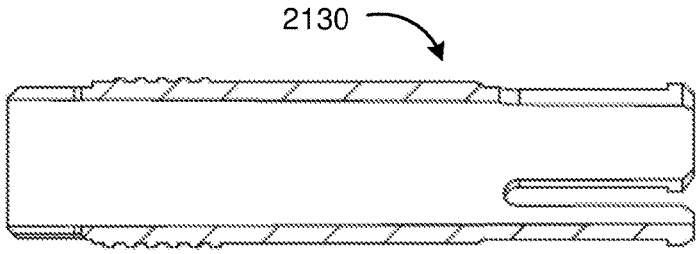
FIG. 15B is cross-sectional view of the adaptor of FIG. 15A.
Figure 15E:
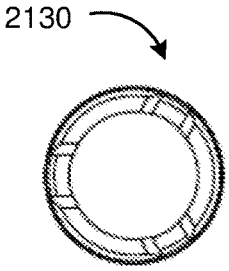
FIG. 15E is a top view of the adaptor of FIG. 15A.
Figure 15C:
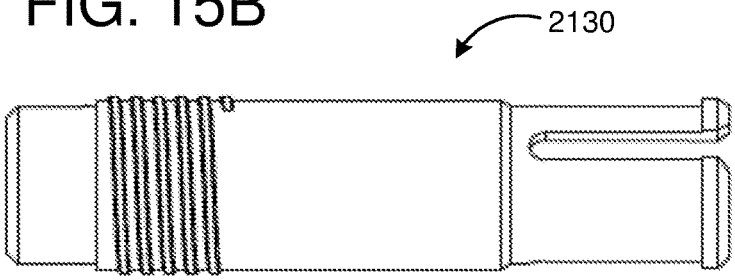
FIG. 15C is a side view of the adaptor of FIG. 15A.
Figure 15F:
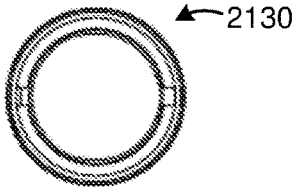
FIG. 15F is a bottom view of the adaptor of FIG. 15A.
Figure 15D:
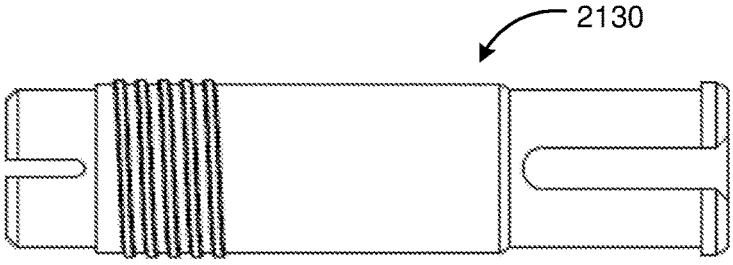
FIG. 15D is a second side view of the adaptor of FIG. 15A.
Figure 16A:
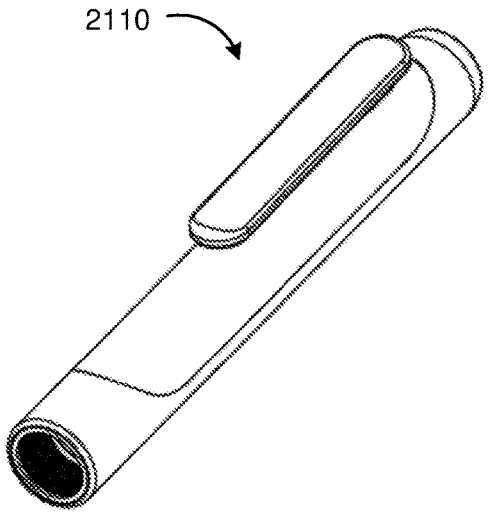
FIG. 16A is a perspective view of one embodiment of a body of the writing instrument of FIG. 11A.
Figure 16B:
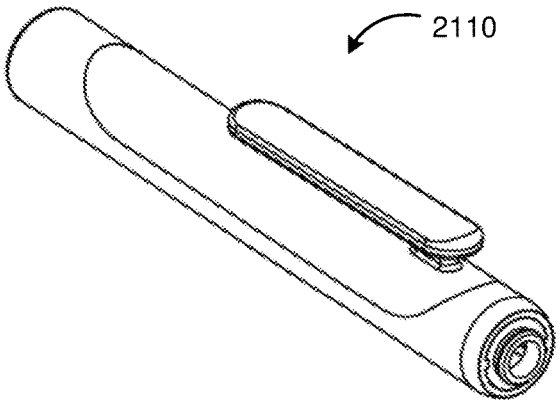
FIG. 16B is a second perspective view of the body of FIG. 16A.
Figure 16C:
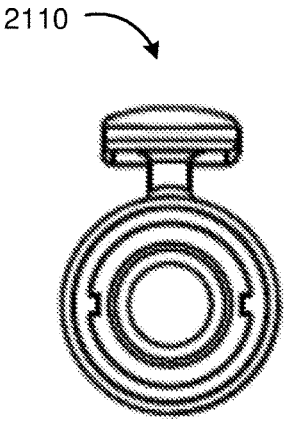
FIG. 16C is a top view of the body of FIG. 16A.
Figure 16D:
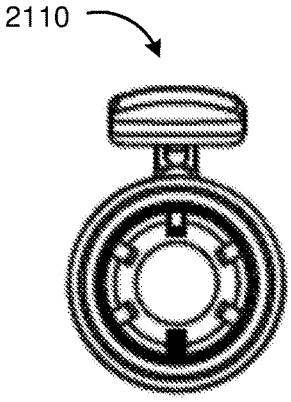
FIG. 16D is a bottom view of the body of FIG. 16A.
Figure 17A:
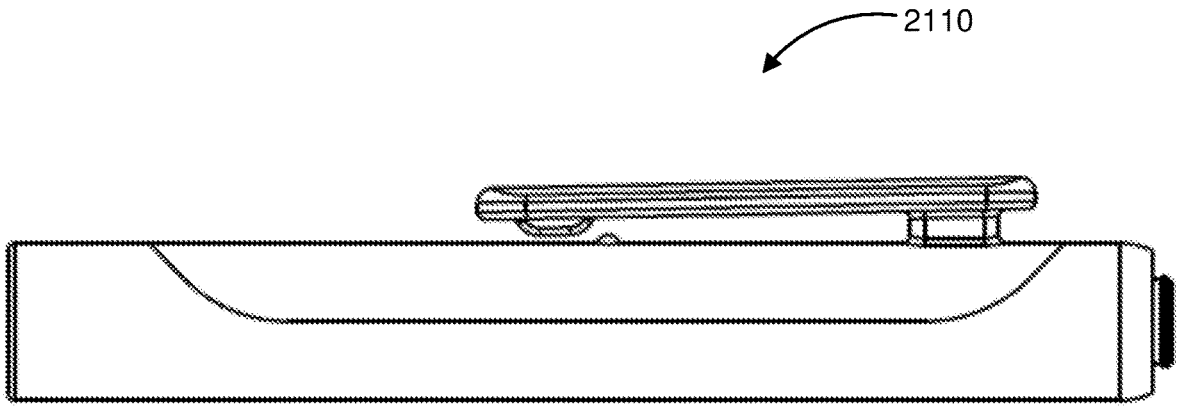
FIG. 17A is a side view of the body of FIG. 16A.
Figure 17B:
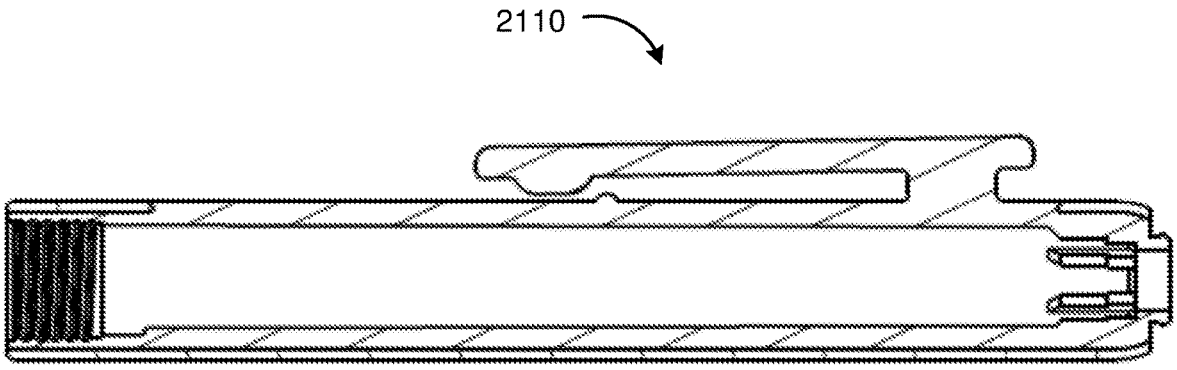
FIG. 17B is a cross-sectional view of the body of FIG. 16A.

With the writing instrument 2100 in the storage position, and because the writing element 2140 is coupled to the body 2110 of the writing instrument 2100, the user cycles the locking mechanism by applying a retracting force on the nosecone 2120, causing the nosecone 2120 and adaptor 2130 to slide rearward towards the body 2110 of the writing instrument 2100. Once the locking mechanism is cycled fully, the nosecone 2120 and adaptor 2130 will lock in the writing position. When the user cycles the locking mechanism again, by applying a retracting force on the nosecone 2120, causing the nosecone 2120 and adaptor 2130 to slide rearward towards the body 2110 of the writing instrument again, the locking mechanism will cycle, allowing the nosecone 2120 and adaptor to slide forward into the storage position. In some instances, the adaptor 2130 is configured to receive the locking element 2930 via the one or more adaptor guide channels 2138. For example, the writing instrument 2100 may be actuated into the writing position (e.g., as shown in FIG. 13B) and the locking element 2930 may slide within the adaptor guide channels 2138. In other instances, the adaptor guide channels 2138 do not receive the locking elements 2930. FIG. 14B shows a section view of the writing instrument 2100 in the storage position, and FIG. 14A shows a detailed section view of the locking mechanism in the storage position. FIG. 13B shows a section view of the writing instrument 2100 in the writing position, and FIG. 13A shows a detailed section view of the locking mechanism in the writing position.

In some embodiments, the writing element 2140 also includes a positioning element 2146. As shown in FIGS. 13B and 14B, the positioning element 2146 may be a stepped increase in the diameter of the writing element 2140. In other embodiments, the positioning element 2146 may be a shelf that protrudes radially outward around the circumference of the writing element 2140.

In one embodiment, as shown in FIG. 12, and in more detail in FIGS. 13A and B, and 14A and B, the locking mechanism may include an extension element 2150, a plunger 2160, and a ratchet 2170. The extension element 2150, plunger 2160, and ratchet 2170 may all be configured to slide over a portion of the writing element 2140 and fit inside the nosecone 2120. In some embodiments, the extension element 2150 applies a force, along a longitudinal axis 2200 of the writing instrument 2100, to the nosecone 2120 which biases the nosecone 2120 away from the body 2110. The extension element 2150 also applies a force, along the longitudinal axis 2200 of the writing instrument 2100, to the plunger 2160 and ratchet 2170, biasing the plunger 2160 against the ratchet 2170, and the plunger 2160 and ratchet 2170 against the writing element 2140 positioning element 2146, the positioning element 2146 limiting the longitudinal motion of the plunger 2160 and ratchet 2170. In one embodiment, as shown in FIG. 12, the extension element 2150 may be a compression spring. The compression spring may fit over the writing element 2140 and inside the nosecone 2120. In some embodiments, the interior surface of the nosecone 2120 is configured to capture the spring and provide a flat surface for the spring to rest against.

Figure 19A:
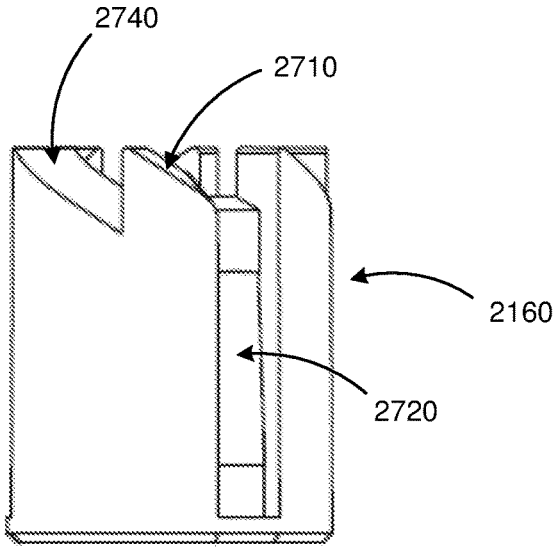
FIG. 19A is a side view of one embodiment of a plunger of the writing instrument of FIG. 11A.
Figure 19B:
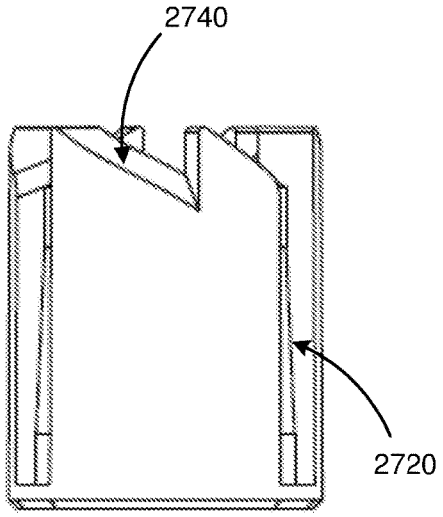
FIG. 19B is a second side view of the plunger of FIG. 19A.
Figure 19C:
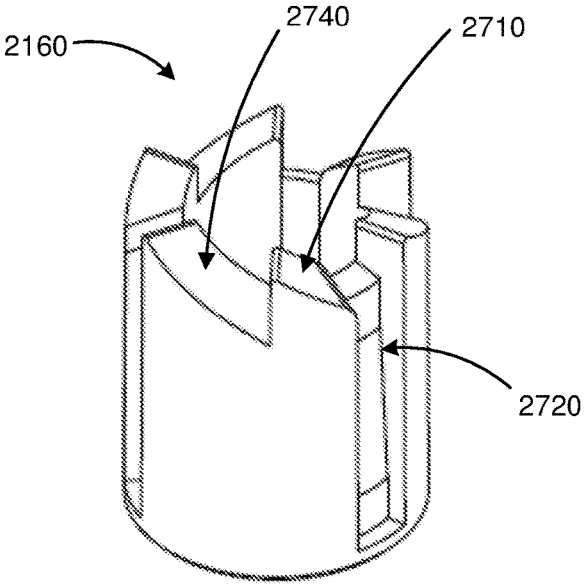
FIG. 19C is a perspective view of the plunger of FIG. 19A.
Figure 19D:
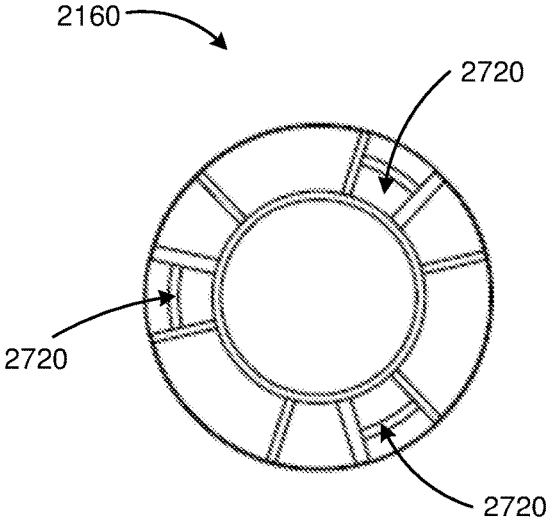
FIG. 19D is a top view of the plunger of FIG. 19A.
Figure 20A:
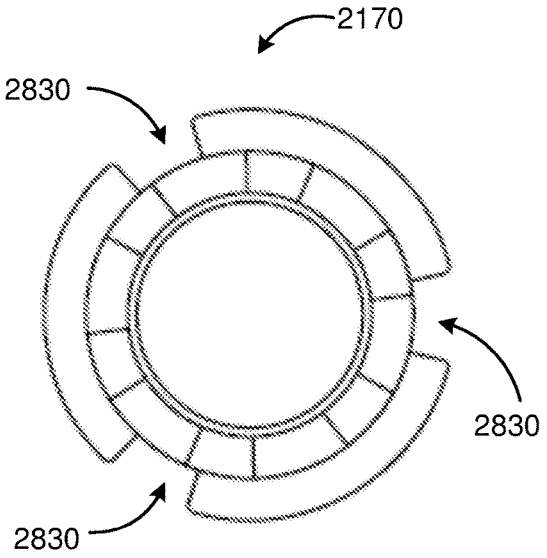
FIG. 20A is a top view of one embodiment of a ratchet of the writing instrument of FIG. 11A.
Figure 20B:
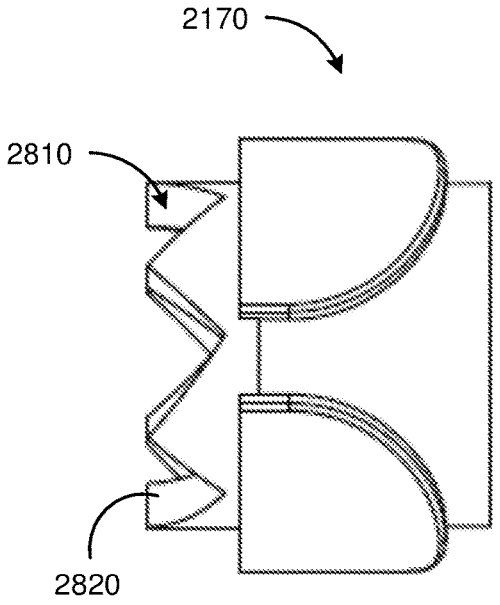
FIG. 20B is a side view of the ratchet of FIG. 20A.
Figure 20C:
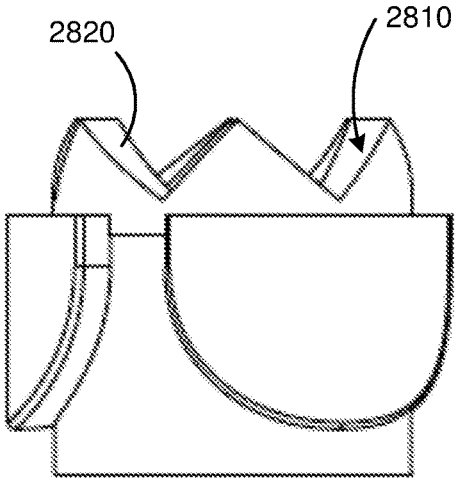
FIG. 20C is a second side view of the ratchet of FIG. 20A.
Figure 20D:
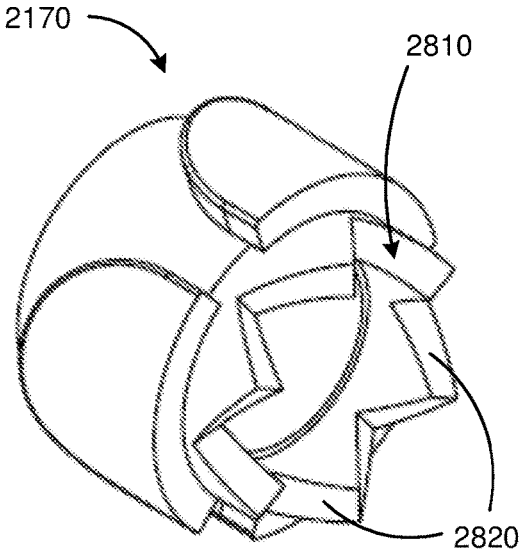
FIG. 20D is a perspective view of the ratchet of FIG. 20A.

FIG. 19C shows an isometric view of, and FIG. 19D shows an end view of, one embodiment of a plunger 2160 in accordance with the disclosure. As shown, the plunger 2160 includes a ratchet mating surface 2710. Similarly, FIG. 20A shows an end view of, and FIG. 20D shows and isometric view of one embodiment of a ratchet 2170, including a plunger mating surface 2810. The ratchet mating surface 2710 may include a plurality of teeth 2740 or notches that are configured to mate with a corresponding plurality of teeth 2820 or notches in the plunger mating surface 2810. These mating surfaces are configured to allow for the selective rotation of the ratchet 2170 and plunger 2160 with respect to each other around the longitudinal axis 2200 of the writing instrument 2100. By varying the shape and spacing of the mating surfaces, the force required to rotate the components may be altered, as well as the degrees of rotation allowed with each cycle of the locking mechanism.

In one embodiment, when the extension element 2150 is compressed by the user, as described above, the extension element 2150 applies a longitudinal force on the plunger 2160 and the ratchet 2170. The longitudinal force biases the ratchet mating surface 2710 and the plunger mating surface 2810 into contact, and the resulting normal force acting on the mating surfaces causes them to rotate around the longitudinal axis 2200 of the writing instrument 2100, until the teeth interlock, preventing further rotation. This causes the plunger 2160 to rotate from a first position to a second position.

Figure 18A:
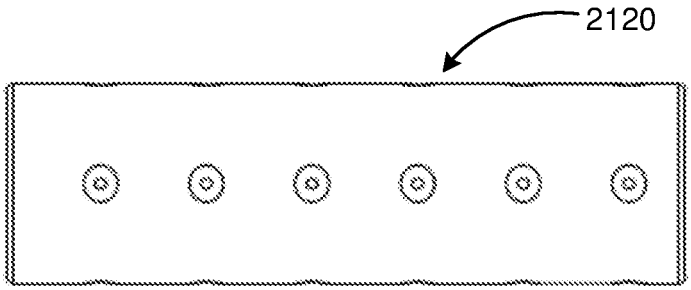
FIG. 18A is a side view of one embodiment of a nosecone of the writing instrument of FIG. 11A.
Figure 18B:
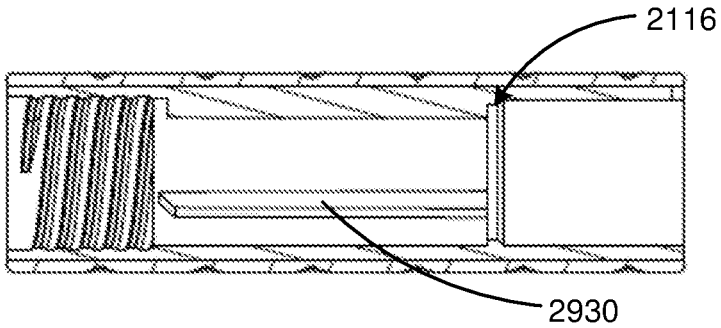
FIG. 18B is a cross-sectional view of the nosecone of FIG. 18A.
Figure 18C:
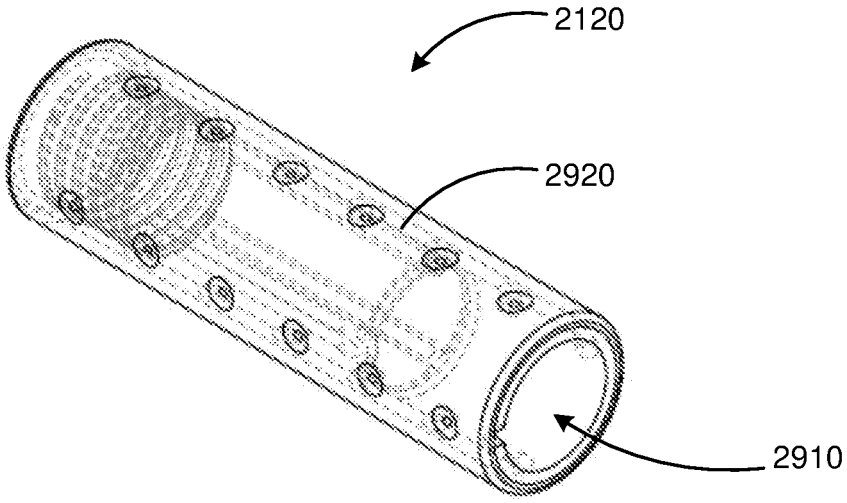
FIG. 18C is a perspective view of the nosecone of FIG. 18A.
Figure 18D:
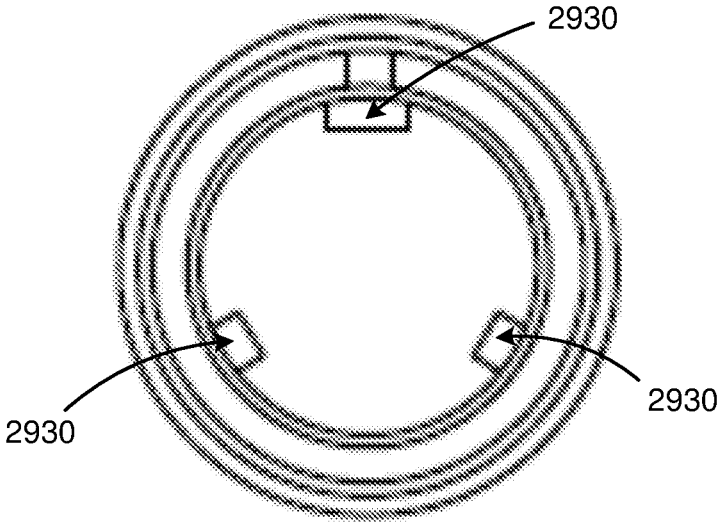
FIG. 18D is a top view of the nosecone of FIG. 18A.
Figure 18E:
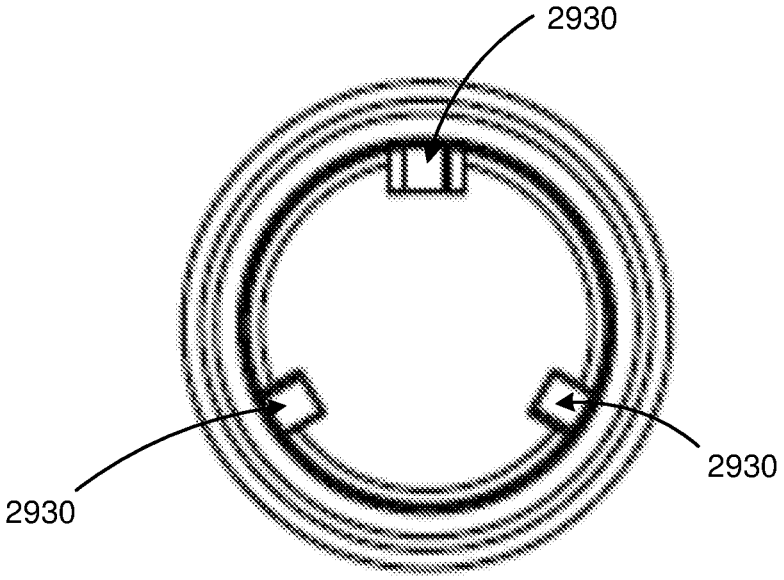
FIG. 18E is a bottom view of the nosecone of FIG. 18A.

In some embodiments, as shown in FIGS. 18A-18C, the nosecone 2120 includes an inner surface 2910 and an outer surface 2920. In one example, the nosecone includes a locking element 2930. As shown in FIG. 18B, the locking element 2930 may include one or more ribs protruding inward from the inner surface 2910 of the nosecone 2120, and extending longitudinally down at least a portion of the length of the inner surface 2910 of the nosecone 2120. In some embodiments, the locking element 2930 is configured to selectively mate with the locking mechanism to prevent rotational and longitudinal movement of the locking mechanism, and more specifically, the plunger 2160 and ratchet 2170 components of the locking mechanism.

In some embodiments, the plunger 2160 includes at least one guide channel 2720, running longitudinally down a portion of the length of an outer surface of the plunger 2160. Similarly, in some embodiments, the ratchet includes at least one guide channel 2830, running longitudinally down a portion of the length of an outer surface of the ratchet 2170. In these embodiments, the plunger guide channel 2720 and ratchet guide channel 2830 may be configured to receive the nosecone 2120 locking element 2930 when the locking element 2930, plunger guide channel 2720, and ratchet guide channel 2830 are aligned. In some instances, the plunger 2160 includes three guide channels 2720 located 2120 degrees apart. In other instances, the plunger 2160 includes two guide channels 2720 located 2180 degrees apart. The plunger 2160 may have any number of guide channels located at varying distances around the plunger 2160.

When the plunger guide channel 2720 and ratchet guide channel 2830 are aligned with the nosecone 2120 locking element 2930, the guide channels allow the nosecone 2120 to move longitudinally forward towards the storage position (because the locking element 2930 can pass through the plunger guide channel 2720 and the ratchet guide channel 2830). When the plunger guide channel 2720 is not aligned with the nosecone 2120 locking element 2930, the nosecone 2120 is constrained from moving forward because the locking element 2930 interferes with the plunger 2160 in the absence of the plunger guide channel 2720 pathway, locking the nosecone 2120 in the writing position. In some embodiments, as shown in FIG. 19D, the plunger 2160 may contain two or more guide channels 2720, spaced evenly around the perimeter of the plunger 2160.

In another example embodiment, at least one locking notch 2740 is included in the plunger 2160. As the guide channel 2720 may receive the locking element 2930 when the writing instrument is in the writing position, the locking notch 2740 may correspond with the rotation of the guide channel 2720 when in the writing position, allowing the locking element 2930 to additionally prevent unwanted rotation of the plunger 2160 when the writing instrument is in the storage position.

In one example of the writing instrument 2100, the extension element 2150 at rest applies force longitudinally forwards (away from the body 2110) on the nosecone 2120 and longitudinally rearward (toward the body 2110) on the plunger 2160 and ratchet 2170. The axial force biases the plunger 2160 and ratchet 2170 against the positioning element 2146. With the writing instrument 2100 starting in the storage position, as the user moves the nosecone 2120 rearward, the extension element 2150 compresses further, increasing the force applied to the plunger 2160. The nosecone 2120 and locking element 2930 slide rearward relative to the stationary writing element 2140, ratchet 2170 and plunger 2160. When the locking element 2930 is in the guide channel 2720, it prevents the plunger 2160 from rotating. As the nosecone 2120 and locking element 2930 slide rearward, the locking element 2930 eventually slides out of the guide channel 2720 in the plunger 2160, at which point the rotational motion created by the longitudinal force applied to the ratchet 2170 and plunger 2160 by the increased compression in the extension element 2150 causes the plunger 2160 to rotate until the mating surfaces of the plunger 2160 and the ratchet 2170 interlock. When the user removes the force on the nosecone 2120, the extension element 2150 pushes the nosecone 2120 away from the body 2110 and the plunger rotates again until the locking notch 2740 in the plunger 2160 mates with the locking element 2930.

To cycle the writing instrument 2100 from the writing position back to the storage position, the user again moves the nosecone 2120 rearward. Once the locking element 2930 exits the locking notch 2740, the compression of the extension element 2150 again applies a longitudinal force to the plunger 2160, causing it to rotate. When the user removes the force from the nosecone 2120, the extension element 2150 pushes the nosecone 2120 away from the body, but, with the locking element 2930 aligned with the guide channel 2720, the nosecone 2120 can extend fully to the storage position.

In yet another embodiment of the disclosure, as shown in FIG. 12, the writing instrument includes a body 2110, a writing element 2140, a nosecone 2120, and a locking mechanism. In this embodiment, the body 2110 may be generally tubular in shape with a body first end 2112 and a body second end 2114. The writing element 2140 may include a writing end 2144 and a mounting end 2142, the mounting end 2142 being removably coupled to the body second end 2114. The nosecone 2120 may be generally tubular in shape and include a nosecone first end 2122 and a nosecone second end 2124. The nosecone first end 2124 may include an aperture 2510 that is configured to allow the writing end 2144 of the writing assembly 2140 to extend through the nosecone first end 2122, and the nosecone second end 2124 may be configured to slidably couple to the body first end 2112. In one example embodiment, the locking mechanism may be configured to selectively lock the nosecone 2120 in an extended position, covering the writing end 2144 of the writing element 2140, and a retracted position, exposing the writing end 2144 of the writing element 2140. In some instances, the body second end 114 may be attached to an end cap 2118. That is, an end cap 2118 may be a hollow cylinder with an open end and a closed end. In this manner, the end cap 2118 may slidably connect to the body second end 2114 to protect the mounting end 2142 of the writing element 2140. In some instances, the end cap 2118 may attach to the mounting end 2142.

In another embodiment, as shown in FIGS. 13A-14B, the writing instrument may include a body 2110 and a nosecone 2120. The body 2110 and the nosecone 2120 may be tubular and slidably connected to each other. The body 2110 may also include a writing assembly 2140, the writing assembly 2140 being removably fixed to the body 2110. The writing instrument may include a locking mechanism that is configured to selectively lock the nosecone 2120 in a first position and a second position. When the nosecone 2120 is in the first position, the nosecone 2120 may be extended in a storage position. When the nosecone 2120 is in the second position, the nosecone 2120 may be retracted in a writing position and the writing assembly 2140 may extend at least partially beyond the nosecone 2120 (i.e., beyond the nosecone 2120 and/or a tip 2126 thereof). Additional embodiments may utilize different combinations of geometries and elements, or utilize different geometries to create and cycle the locking mechanism.

The meanings of the terms used herein will be apparent to one of ordinary skill in the art or will become apparent to one of ordinary skill in the art upon review of the detailed description when taken in conjunction with the several drawings and the appended claims.

Although certain embodiments of the disclosure are described herein and shown in the accompanying drawings, one of ordinary skill in the art will recognize that numerous modifications and alternative embodiments are within the scope of the disclosure. Moreover, although certain embodiments of the disclosure are described herein with respect to specific mechanisms and configurations, it will be appreciated that numerous other mechanisms and configurations are within the scope of the disclosure. Conditional language used herein, such as "can," "could," "might," or "may," unless specifically stated otherwise, or otherwise understood within the context as used, generally is intended to convey that certain embodiments include, while other embodiments do not include, certain features, elements, or functional capabilities. Thus, such conditional language generally is not intended to imply that certain features, elements, or functional capabilities are in any way required for all embodiments.

We claim:

1. A writing instrument, comprising:

a body, a nosecone, and an adaptor, the body, nosecone, and adaptor each being a generally hollow tubular shape and having a first end and a second end, wherein the first end of the adaptor is configured to slidably couple to the second end of the nosecone and the second end of the adaptor is coupled to the first end of the body;

a writing element having a mounting end and a writing end, the mounting end being removably coupled to the second end of the body; and a locking mechanism configured to selectively lock the nosecone in a storage position and in a writing position, wherein when the nosecone is in the storage position, the nosecone is extended relative to the body and covers the writing end of the writing element, and when the nosecone is in the writing position, the nosecone is retracted relative to the body and the writing end of the writing element extends at least partially beyond the nosecone, wherein the locking mechanism comprises an extension element, a plunger, and a ratchet, the extension element, plunger, and ratchet being configured to slide over a portion of the writing element and fit inside the nosecone.

2. The writing instrument of claim 1, wherein the writing element further comprises a positioning element.

3. The writing element of claim 1, wherein the positioning element comprises a shelf that protrudes radially outward around a circumference of the writing element.

4. The writing instrument of claim 2, wherein the extension element applies force, along a longitudinal axis of the writing instrument, to the nosecone, biasing the nosecone away from the body, and to the plunger and ratchet, biasing the plunger against the ratchet, and the plunger and ratchet against the writing element positioning element, the writing element positioning element limiting the longitudinal motion of the plunger and ratchet.

5. The writing instrument of claim 4, wherein the plunger comprises a ratchet mating surface, and the ratchet comprises a plunger mating surface, the ratchet and plunger mating surfaces being configured to allow for a selective rotation of the ratchet and plunger with respect to each other around a longitudinal axis of the writing instrument.

6. The writing instrument of claim 4, wherein the extension element, when compressed by a user, applies a longitudinal force to the plunger, causing the plunger to rotate around the longitudinal axis of the writing instrument from a first position to a second position.

7. The writing instrument of claim 4, wherein the extension element is a compression spring.

8. The writing instrument of claim 4, wherein the nosecone further comprises an inner surface, an outer surface, and a nosecone locking element.

9. The writing instrument of claim 8, wherein the nosecone locking element comprises at least one rib, protruding inward from, and running longitudinally down at least a portion of a length of, the inner surface of the nosecone, and wherein the nosecone locking element is configured to selectively mate with the locking mechanism to prevent rotational and longitudinal movement of the locking mechanism.

10. The writing instrument of claim 8, wherein the plunger further comprises at least one guide channel, the guide channel being configured to receive the nosecone locking element, wherein the guide channel is configured such that, when the guide channel is aligned with the nosecone locking element, the nosecone is allowed to move toward, and lock into, the storage positions and wherein the guide channel is configured such that, when the guide channel is not aligned with the locking element, the nosecone is allowed to move toward, and lock into, the writing position.

11. The writing instrument of claim 1, wherein the second end of the adaptor and the first end of the body further comprise mating threads to connect the body and adaptor.

12. The writing instrument of claim 1, wherein the adaptor is configured to provide a visual indication of a status of the writing instrument.

13. The writing instrument of claim 1, further comprising a bellows disposed around the adaptor, wherein the bellows is configured to provide a visual indication of a status of the writing instrument.

14. The writing instrument of claim 1, wherein the writing element comprises a thermochromic ink.

15. The writing instrument of claim 1, wherein the first end of the adaptor further comprises a recess configured to mate with the second end of the nosecone, the nosecone comprising a ledge configured to secure the adaptor at least partially within the nosecone.

16. A writing instrument, comprising:

a body, a nosecone, and an adaptor, the body, nosecone, and adaptor each being a generally hollow tubular shape and having a first end and a second end, wherein the first end of the adaptor is coupled to the second end of the nosecone and the second end of the adaptor is configured to slidably couple to the first end of the body;

a writing element having a mounting end and a writing end, the mounting end being removably coupled to the second end of the body; and a locking mechanism configured to selectively lock the nosecone in a storage position and in a writing position, wherein when the nosecone is in the storage position, the nosecone and adaptor are extended relative to the body and the nosecone covers the writing end of the writing element, and when the nosecone is in the writing position, the nosecone and adaptor are retracted relative to the body and the writing end of the writing element extends at least partially beyond the nosecone, wherein the second end of the adaptor further comprises a recess configured to mate with the first end of the body, the body comprising a ledge configured to secure the adaptor at least partially within the body.

17. The writing instrument of claim 16, wherein the first end of the adaptor and the second end of the nosecone further comprise mating threads to connect the adaptor and the nosecone.

18. The writing instrument of claim 16, further comprising a bellows disposed around the adaptor, wherein the bellows is configured to provide a visual indication of a status of the writing instrument.

* * * * *